US007520738B2

(12) United States Patent
Katz

(10) Patent No.: US 7,520,738 B2
(45) Date of Patent: Apr. 21, 2009

(54) CLOSED SYSTEM ROTARY MACHINE

(75) Inventor: André Katz, Paris (FR)

(73) Assignees: Centre National de la Recherche Scientifique (CNRS), Paris (FR); Ecole Polytechnique, Palaiseau (FR)

( * ) Notice: Subject to any disclaimer, the term of this patent is extended or adjusted under 35 U.S.C. 154(b) by 46 days.

(21) Appl. No.: 10/526,971

(22) PCT Filed: Sep. 4, 2003

(86) PCT No.: PCT/FR03/02642

§ 371 (c)(1),
(2), (4) Date: Jul. 19, 2005

(87) PCT Pub. No.: WO2004/022976

PCT Pub. Date: Mar. 18, 2004

(65) Prior Publication Data

US 2005/0271535 A1 Dec. 8, 2005

(30) Foreign Application Priority Data

Sep. 5, 2002 (FR) ..... 02 10959

(51) Int. Cl.
*F04C 2/10* (2006.01)

(52) U.S. Cl. ..... 418/150; 418/166; 418/171; 418/61.2

(58) Field of Classification Search ..... 418/150, 418/166, 171, 61.2, 131, 132, 61.1, 58, 172, 418/173
See application file for complete search history.

(56) References Cited

U.S. PATENT DOCUMENTS 1,833,993 A * 12/1931 Hill ..... 409/51
1,892,217 A 12/1932 Moineau (Continued)

FOREIGN PATENT DOCUMENTS

DE 42 04 186 8/1993

(Continued)

OTHER PUBLICATIONS

Wankel, Felix "Einteilung Der Rotationskolbenmaschinen" Einteilung Der Rotations—Kolbenmaschinen. Rotations—Kolbenmaschinen Mit Parallelen Drehachsen Und Arbeitsraumumwandungen Aus Starrem Werkstoff, Stuttgart, Deutsche Verlag—Anstalt, DE, 1952, pp. 7-59, XP 002204164 Capsulisme IV/7.

*Primary Examiner*—Thomas E Denion
*Assistant Examiner*—Mary A Davis
(74) *Attorney, Agent, or Firm*—Young & Thompson

(57) ABSTRACT

A closed system rotary machine has an inner shaped element (1) and an outer shaped element (2) which define therebetween cavities or capsules having a variable volume ($V_1$, $V_9$). The contact points which define the capsules ($C_1$, $C_9$) are disposed along lines of action ($CA_1$, $CA_2$, $CA_3$) which are concurrent at junction points BN and BM, where the cavities begin and end respectively. The contacts ($C_2$) at points located on the tangent (T) common to both pitch circles (6, 7) are osculating elements with a shared centre of curvature which is situated at the rolling point (R) of the pitch circles (6, 7). The invention can be used to ensure that the capsules form and disappear very gradually and to facilitate the distribution of the capsules when they are forming and disappearing in order to increase the leak paths.

35 Claims, 19 Drawing Sheets

U.S. PATENT DOCUMENTS

| | | | | | |
|---|---|---|---|---|---|
| 2,209,201 | A | * | 7/1940 | Hill | 475/180 |
| 2,988,008 | A | * | 6/1961 | Wankel | 418/113 |
| 3,117,561 | A | * | 1/1964 | Bonavera | 123/205 |
| 3,695,791 | A | * | 10/1972 | Brundage | 418/131 |
| 3,884,600 | A | * | 5/1975 | Gray | 418/61.2 |
| 5,114,325 | A | * | 5/1992 | Morita | 418/171 |
| 5,380,177 | A | | 1/1995 | Leroy et al. | |
| 5,674,060 | A | * | 10/1997 | Buchmuller et al. | 418/39 |
| 6,106,250 | A | | 8/2000 | Morita et al. | |

FOREIGN PATENT DOCUMENTS

| | | | |
|---|---|---|---|
| DE | 44 25 429 | | 1/1996 |
| EP | 0 539 273 | | 4/1993 |
| EP | 0 799 996 | | 10/1997 |
| EP | 0 870 926 | | 10/1998 |
| GB | 1 002 642 | | 8/1965 |
| RU | 2140018 | * | 10/1999 |
| WO | WO 93/08402 | | 4/1993 |

* cited by examiner

CLOSED SYSTEM ROTARY MACHINE

This invention relates to a rotary displacement machine.

"Displacement machine" is given to mean a machine in which two profiled members have annular profiles that mesh with one another defining variable volume chambers—or capsules—between them.

The invention relates more particularly to machines in which one of the profiles is inside the other, one being m-lobed and the other (m−1)-lobed, where the integer m is greater than or equal to 2.

The term "m-lobed" profile is used to denote an annular profile defined by a pattern forming a lobe dome and a lobe hollow, this pattern being repeated m times around the centre of a pitch circle associated with the profile.

An (m−1)-lobed profile is an annular profile defined by a pattern forming a lobe dome and a lobe hollow, this pattern being repeated (m−1) times around the centre of a pitch circle associated with the profile.

The profiles cooperate with each other through a sort of meshing during which their respective pitch circles roll on each other at a rolling point that is fixed relative to a connecting member relative to which the two profiled members turn, each on an axis passing through the centre of its pitch circle.

Displacement machines can for example be hydraulic motors, hydraulic pumps, compressors or expansion motors.

EP-A-0870926 describes a displacement machine of the so-called "gerotor" type, that is, in which the inner profiled member is (m−1)-lobed. The geometry of this machine is conventional in itself. The document relates more particularly to the creation of a given play between the profiles.

EP-539273-B1 describes various displacement machines, and in particular machines with two lobes on the inner profile and three on the outer profile, and conversely machines with three lobes on the inner profile and just two lobes on the outer profile.

U.S. Pat. No. 1,892,217 describes the Moineau pump. Instead of having cylindrical profiles, this gerotor type machine has helical profiled members with a total helix angle of several revolutions. The chambers are formed at an axial end of the profiled members and are then transported without any variation in volume to the other end, where they disappear. Two remarkable results are obtained: the distribution is simplified in the extreme as the chambers simply have to open freely on intake at one end and on discharge at the other end. Furthermore, the flow rate is completely constant.

Numerous documents such as U.S. Pat. No. 6,106,250, DE 42 04 186 A1, EP 0 094 379 B1, DE 44 25 429 A1 and EP 0 799 966 A2 describe machines with a Wankel type geometry, that is, with a generally triangular rotor with curved surfaces effecting a planetary movement in a bi-lobed stator.

WO 93/08402 describes improvements to the Moineau pump.

In the prior art the profiles are often only conjugate in an approximate way. Flexible sealing members are provided to compensate for the approximations in conjugation. For example, in the Moineau pump (U.S. Pat. No. 1,892,217), the inner lining of the outer profiled member is flexible. In most Wankel type machines, retractable segments are provided at the ends of the triangular rotor and sometimes also at the vertices of the lobes of the outer profiled member. Even in the best known machines, the leak paths between successive chambers are relatively short and there are problems in switching a chamber from intake to discharge.

The object of this invention is to find an improvement with regard to the quality of the contact between the profiles, the switching between intake and discharge by the distribution system, and the progressiveness of the appearance and disappearance of each chamber.

More particularly, a family of geometries has been found according to the invention, together with associated methods of determination, as a result of which the profiles are in osculating contact in the stages of appearance and disappearance of a chamber. Osculating contact is given to mean a point of contact at which the curvatures of the two profiles are continuous, equal and in the same direction. On the appearance of a chamber, the osculating contact splits into two contacts between which the chamber forms. On the disappearance of a chamber, two separate contacts come together increasingly until they become a single, and then simple, osculating contact.

According to the invention, the displacement machine comprising:

- two profiled members, inner and outer respectively, which respectively have an annular inner profile and an annular outer profile,
- a connecting member connected rotatably to each of the two profiled members along a respective axis of rotation, and in which:
- one of the profiles is m-lobed and the other is (m−1)-lobed, and they are defined around the axis of rotation of their respective profiled member by m and (m−1) respectively, pattern(s) comprising a lobe dome arc and a lobe hollow arc,
- each profile is the envelope of the other during relative rotations of the profiled members around their respective axis of rotation with meshing of their profiles, which define the chamber contours between them, and rolling without sliding between two pitch circles centred on the respective axes of rotation, is characterised in that the relative positions of the profiled members for which a point of contact between the profiles is located on the tangent to the two pitch circles at their mutual rolling point, the profiled members have at said point of contact equal continuous curvatures in the same direction with said rolling point as their common centre.

Preferably, the displacement machine is characterised in that

- points M on a first of the two arcs of the m-lobed profile being defined by two functions $\rho(\delta)$ and $\sigma(\delta)$ connecting the parameters $\rho$ and $\sigma$ to the parameter $\delta$ seen as a coordinate on the arc and which are:

$\rho$: measured along the normal to the arc at point M, the distance between point M and the middle N between the two points of intersection P and D, proximal and distal respectively, of the said normal with the pitch circle with centre O of the m-lobed profile, and with a radius assumed equal to 1, the proximal point of intersection P being located between point M on the given arc and-the distal point of intersection D, $\delta$: angular half-distance between D and P relative to the centre O, measured clockwise, $\sigma$: polar angle of the proximal point of intersection P relative to O, minus $\delta$, the functions $\rho(\delta)$ and $\sigma(\delta)$ having a domain of definition between $\delta=0$ and $\delta=\pi$,

- two arcs of the pattern of the (m−l)-lobed profile are a proximal conjugate arc and a distal conjugate arc defined below in a Cartesian reference system with their origin at the centre 0 of the pitch circle associated with the m-lobed profile:

a)proximal conjugate arc:

$$x_{CjP}(\delta) = \left(1 + (\sin(\delta) - m\rho(\delta))\sin\left(\frac{\delta - m\sigma(\delta)}{m-1}\right) + (m-1)\cos(\delta)\cos\left(\frac{\delta - m\sigma(\delta)}{m-1}\right)\right)\Big/ m$$

$$y_{CjP}(\delta) = \left((\sin(\delta) - m\rho(\delta))\cos\left(\frac{\delta - m\sigma(\delta)}{m-1}\right) - (m-1)\cos(\delta)\sin\left(\frac{\delta - m\sigma(\delta)}{m-1}\right)\right)\Big/ m$$

b)distal conjugate arc:

$$x_{CjD}(\delta) = \left(1 + (\sin(\delta) - m\rho(\delta))\sin\left(\frac{\delta + m\sigma(\delta)}{m-1}\right) + (m-1)\cos(\delta)\cos\left(\frac{\delta + m\sigma(\delta)}{m-1}\right)\right)\Big/ m$$

$$y_{CjD}(\delta) = \left(-(\sin(\delta) + m\rho(\delta))\cos\left(\frac{\delta + m\sigma(\delta)}{m-1}\right) + (m-1)\cos(\delta)\sin\left(\frac{\delta + m\sigma(\delta)}{m-1}\right)\right)\Big/ m$$

If one refers to the mathematical complexity associated with the design of displacement machines, the solution proposed according to the invention is remarkably simple.

A first arc of one of the profiles and a pitch circle for that profile can be chosen, and then the arc is defined mathematically in the very specific parameterisation that has been devised according to the invention, by establishing the two functions $\rho(\delta)$ and $\sigma(\delta)$. This initially chosen arc is known as the "given arc".

Directly thereafter, by application of the formulae according to the invention, the proximal conjugate arc and the distal conjugate arc are obtained by their Cartesian coordinates having their origin at the centre O of the pitch circle associated with the given arc. The conjugate profile of the given arc is obtained by concatenation of the proximal conjugate arc and the distal conjugate arc. Concatenation means that the two arcs, each taken in the entirety of its length corresponding to a variation of $\delta$ over the interval $[0, \pi]$ are connected end to end by the points at which $\delta=0$. The formulae automatically realise that the two arcs, proximal and distal, have not only the same tangent but also the same curvature at their connection point and this curvature is also the same as the curvature at a corresponding extremity of the given arc. The normal to the conjugate profile at the connection point is tangent to the respective pitch circles of the chosen arc and the conjugate profile at the rolling point of these circles on each other. The radius of the pitch circle of the given arc having been chosen arbitrarily as equal to 1, the radius of the pitch circle of the conjugate profile is equal to $(m-1)/m$. The pitch circle of the conjugate profile is therefore determined. The complete conjugate profile is then obtained by concatenating $(m-1)$ times the pattern made up of the proximal conjugate arc and the distal conjugate arc over $(m-2)$ rotations at an angle of $2\pi/(m-1)$ around the centre O' of the pitch circle of the conjugate profile.

For the second arc of the m-lobed profile, or complementary arc of the given arc, there are two possible scenarios depending on the geometry chosen for the given arc. According to the invention, a distinction is made between these two scenarios according to the value of the derivative $\rho'$ of the function $\rho$ relative to its variable $\delta$ at points O and $\pi$.

In a first scenario, the derivative $\rho'$ relative to $\delta$ where $\delta=0$ and $\delta=\pi$ satisfies the following strict inequalities:

$$1/m > \rho'(0) > 0$$

$$-1/m < \rho'(\pi) < 0$$

the m-lobed profile is then inside the $(m-1)$-lobed profile, and the m-lobed profile is complemented by a proximal complementary arc defined by its coordinates in the said Cartesian reference system:

$$x_{CpP}(\delta) = \left((2\sin(\delta) - m\rho(\delta))\sin\left(\frac{2\delta}{m} - \sigma(\delta)\right) + m\cos(\delta)\cos\left(\frac{2\delta}{m} - \sigma(\delta)\right)\right)\Big/ m$$

$$y_{CpP}(\delta) = \left((2\sin(\delta) - m\rho(\delta))\cos\left(\frac{2\delta}{m} - \sigma(\delta)\right) - m\cos(\delta)\sin\left(\frac{2\delta}{m} - \sigma(\delta)\right)\right)\Big/ m$$

A first class of machines according to the invention is thus obtained, in which the inner profile has one more lobe than the outer profile.

For this first class of machines, the two conjugate arcs, proximal and distal respectively, defined by the formulae according to the invention, are positioned radially outside the given arc, and the complementary arc of the given arc complements the m-lobed profile inside the conjugate, $(m-1)$-lobed, profile.

In a second scenario, the derivative $\rho'$ relative to $\delta$ where $\delta=0$ and $\delta=\pi$ satisfies the following strict inequalities:

$$-1/m < \rho'(0) < 0$$

$$1/m > \rho'(\pi) > 0$$

The m-lobed profile is outside the $(m-1)$-lobed profile; and the m-lobed pattern is complemented by a distal complementary arc defined by the following set of Cartesian coordinates around the centre O:

$$x_{CpD}(\delta) = \left((2\sin(\delta) + m\rho(\delta))\sin\left(\frac{2\delta}{m} + \sigma(\delta)\right) + m\cos(\delta)\cos\left(\frac{2\delta}{m} + \sigma(\delta)\right)\right)\Big/ m$$

$$y_{CpD}(\delta) = \left(-(2\sin(\delta) + m\rho(\delta))\cos\left(\frac{2\delta}{m} + \sigma(\delta)\right) + m\cos(\delta)\sin\left(\frac{2\delta}{m} + \sigma(\delta)\right)\right)\Big/ m$$

This gives a second class of machines in which the conjugate, $(m-1)$-lobed, profile is automatically defined as being radially inside the m-lobed profile to which the given arc belongs.

The formulae above, whether they relate to the first or second class of machines, do not require that the given arc has an axis of symmetry.

If the given arc does not have an axis of symmetry, machines are obtained in which the chamber growth and shrinkage processes are not symmetrical to each other.

Other specific features and advantages of the invention will become apparent from the description below, which relates to non-limitative examples.

FIGS. 28A to 28F very schematically show, in six different states, a first embodiment of a multistage machine according to the invention, with a bi-lobed intermediate profiled member mounted between two tri-lobed profiles; and FIGS. 29A to 29F very schematically show, in six different states, a second embodiment of a multistage machine according to the invention, with a tri-lobed intermediate profiled member mounted between two bi-lobed profiles.

Figure 1:
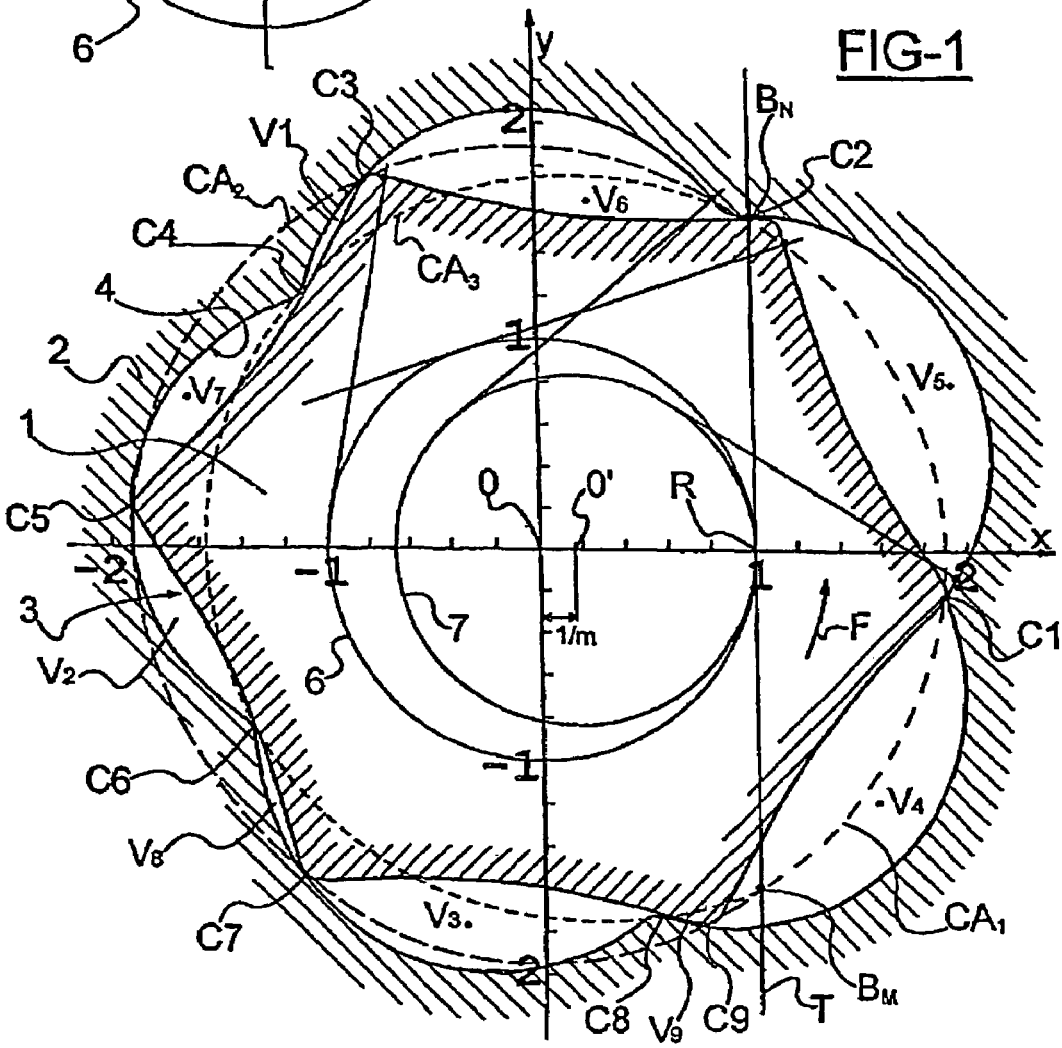
FIG. 1 is a front view of the profiled members, showing certain specific geometric features of a machine in the first class according to the invention.

In the example shown in FIG. 1, the machine comprises a profiled inner member 1 and a profiled outer member 2 that surrounds the profiled inner member 1.

The profiled inner member 1 has on its outer circumference a lobed profile 3 and the profiled outer member 2 has on its inner circumference a lobed profile 4 that surrounds the lobed profile 3 of the profiled inner member 1.

One of the profiles has one more lobe than the other. In the example in FIG. 1, which corresponds to what is known within the scope of the invention as a machine in the first class, the inner profile 3 has one more lobe than the outer profile 4. It is said that the inner profile 3 is m-lobed and that the outer profile 4 is (m−1)-lobed.

In the example in FIG. 1, m=6, so that the inner profile 3 is six-lobed and the profile 4 of the profiled outer member 2 is five-lobed.

Each profile 3, 4 has rotation symmetry around the origin of the pitch circle associated with it, and the order of this symmetry is the number of its lobes.

Thus, the profile 3 of the inner member 1 has symmetry of order 6 around a centre O, and the profile 4 of the profiled outer member 2 has symmetry of order 5 around a centre O'.

There is a distance 1/m along an axis Ox between the centres O and O'.

Each lobe is defined by a respective pattern, the profile 3 or 4 being defined by repeating its respective pattern m times or (m−1) times respectively by rotation of $2\pi/m$ or $2\pi/(m-1)$ respectively around the centre of symmetry O or O' respectively.

Each of the profiles 3, 4 has a pitch circle 6, 7 with a centre O and O' respectively. The radii of the pitch circles are proportionate to the number of lobes of the profile with which they are respectively associated, so that they are tangent to each other at a point R located on the axis Ox.

Each pattern is made up of a "lobe dome" and a "lobe hollow". A "lobe dome" is a protruding part, i.e. a part radially distant from the centre for the inner profile and a part radially close to the centre for the outer profile. Conversely, a "lobe hollow" is a generally concave part, i.e. close to the centre for the inner profile and distant from the centre for the outer profile. The highest point of a lobe dome is known as the "lobe vertex" and the deepest point of a lobe hollow is known as the "lobe bottom".

In the example shown, the profiles have reflection symmetry relative to radii passing through the lobe vertices and lobe bottoms, but this symmetry is not vital to the invention, as will be seen below.

The m-lobed profiled member 1 is articulated to a connecting member, not shown in FIG. 1, along an axis of rotation that coincides with the centre O. Similarly, the (m−1)-lobed profiled member 2 is articulated to the connecting member along an axis of rotation that coincides with the centre O' of its pitch circle.

In operation, the two profiled members effect a rotation around their respective axis of rotation O, O' relative to the connecting member, in such a way that the two pitch circles 6, 7 roll on each other at point R, which remains immobile relative to the connecting member. As a result, the reference Ox, Oy is immobile relative to the connecting member, as are the centres O and O'. Moreover, the description given thus far also implies that the m-lobed profiled member 1 executes (m−1)/m of a revolution when the (m−1)-lobed profiled member 2 effects a complete revolution.

During this combined movement of the two profiled members 1 and 2, each lobe dome on each profile 3 or 4 is in contact with the other profile. In a region situated to the right of FIG. 1, and more specifically radially beyond a common tangent T to the two pitch circles 6 and 7 at their mutual rolling point R, each lobe dome of one of the profiles forms a unique contact with a lobe dome of the other profile. Such a unique contact $C_1$ is in particular shown. On the other side of the common tangent T, each lobe dome of one of the profiles is in contact with a lobe hollow of the other profile. Contacts $C_3$, $C_5$, $C_7$ and Cg can thus be seen between a dome of the m-lobed profile and a hollow of the (m−1)-lobed profile, which alternate with contacts $C_4$, $C_6$ and $C_8$ between a dome of the (m−1)-lobed profile and a hollow of the m-lobed profile.

The trajectories of the contact points relative to the connecting member represented by the reference Oxy are known as curves of action. In the region situated to the right of the common tangent T, there is a single curve of action $CA_1$, the extremities of which are points $B_N$ and $B_M$ situated on the tangent T. On the other side of the tangent T, there are two curves of action $CA_2$ and $CA_3$, which correspond to the trajectory of the points of contact formed by the domes of the m-lobed profile 3 and by the points of contact formed by the domes of the (m−1)-lobed profile 4 respectively. The extremities of the two curves of action $CA_2$ and $CA_3$ are also formed by points $B_N$ and $B_M$, which will be referred to as bifurcation points of the curves of action.

In the specific situation shown in FIG. 1, one of the points of contact, denoted by $C_2$, coincides with the bifurcation point $B_N$. This point of contact marks the boundary between a hollow and a dome on one side of the pattern of each of the two profiles. In another situation, shown in FIG. 2C, a point of contact coincides with the bifurcation point $B_N$ and marks the boundary between a hollow and a dome on another side of the pattern of each of the two profiles.

According to an important specific feature of this invention, the profiles, which are determined in a manner that will be described below, define an osculating contact between the two profiles when the point of contact is made at $B_N$ or $B_M$. This means that the profiles have at their point of contact located at $B_N$ or $B_M$, not only a common tangent, but also equal continuous curvatures in the same direction.

Furthermore, the centre of curvature common to both profiles in their osculation coincides with the rolling point R, so that their radius of curvature is equal to the distance between R and $B_N$, or $B_M$ respectively. This osculation ensures contact between the two profiles that is of an excellent quality.

When the profiled member 1 rotates around its centre O in the direction shown by the arrow F, the contact such as $C_1$ follows the curve of action $CA_1$ until it coincides with the bifurcation point $B_N$ to form the aforementioned osculation. From there, the contact splits into two separate contacts each following one of the two curves of action $CA_2$ and $CA_3$. Then these two separate contacts merge once more into an osculating contact at the bifurcation point $B_M$.

Capsules—or chambers—are defined between the two profiles 3 and 4 and between the successive points of contact. In the situation shown in FIG. 1, a chamber is appearing at the point of contact $C_2$. During the rotation of the profiled inner member 1 and the correlative rotation of the profiled outer member 2, the chamber appearing at the bifurcation point $B_N$ will successively form the chambers $V_1, V_2, \ldots V_9$. Chambers $V_1$ to $V_4$ are in the volume growth phase whilst chambers $V_5$ to $V_9$ are in the volume shrinkage phase. The growth phase extends over almost an entire revolution, as does the shrinkage phase, so that the complete cycle extends over slightly less than two revolutions. If the machine is a hydraulic motor, the hydraulic fluid is at high pressure in chambers $V_1$ to $V_4$ in the growth phase, and at low pressure in chambers $V_5$ to $V_9$ in the shrinkage phase. The chambers in the growth phase and under pressure alternate with the chambers in the shrinkage phase and not under pressure. If the hydraulic machine operates as a pump, the same alternation is seen, except that the chambers in the shrinkage phase are under pressure and the chambers in the growth phase are taking in the fluid to be pumped.

There are two consequences of this. Firstly, the radial load on the bearings of the machine is low. Secondly, there is self-lubrication at each point of contact due to the leaks between high pressure and low pressure. This self-lubrication should in particular facilitate the starting of the machine, without any sticking effect.

Furthermore, the osculating contact on the appearance and disappearance of the chambers at the bifurcations $B_N$ and $B_M$ respectively, results firstly in each chamber appearing and disappearing on a relatively large contact area, and secondly with a very slow growth in volume. These two circumstances facilitate the creation of orifices of the appropriate size to start the supply and end the discharge of each chamber, as it appears and as it disappears respectively, as will be seen below.

Figure 2A:
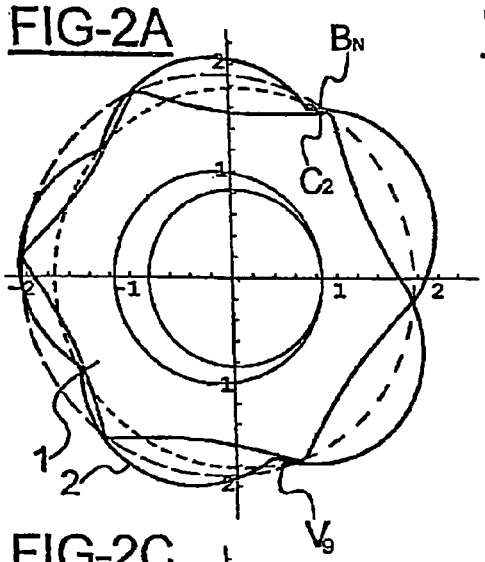
FIGS. 2A to 2F are views analogous to FIG. 1, but on a smaller scale, showing six successive states of the machine in FIG. 1.
Figure 2B:
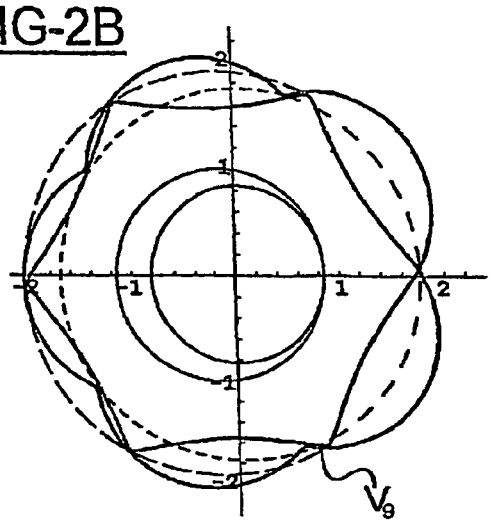
Figure 2C:
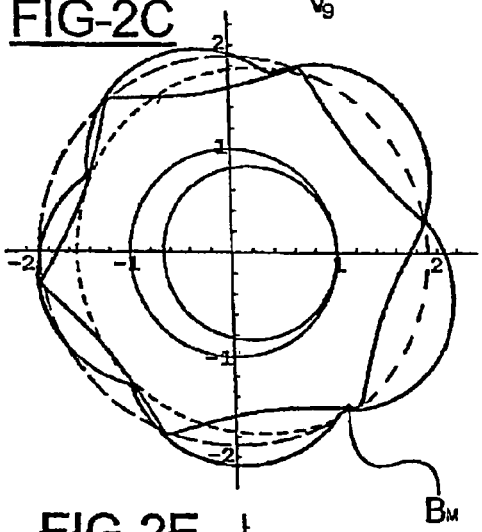
Figure 2D:
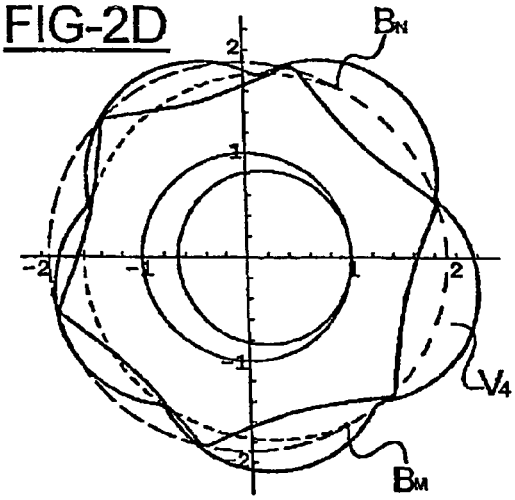
Figure 2E:
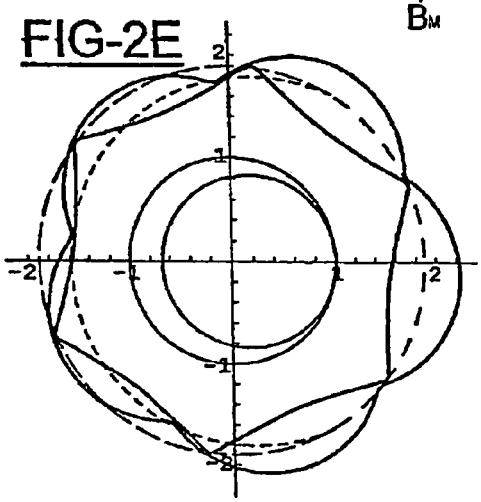
Figure 2F:
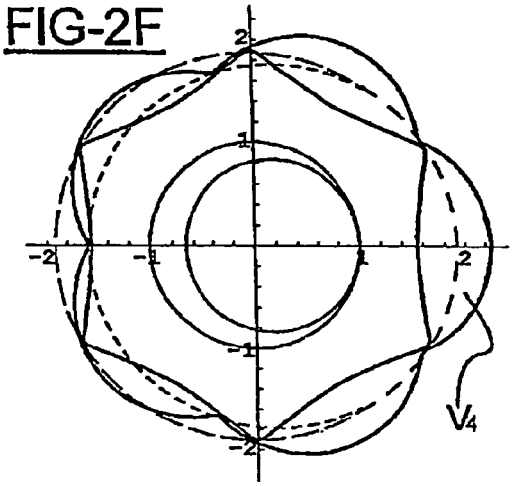

FIGS. 2A to 2F show six successive angular positions of the two profiled members 1 and 2 of the machine in FIG. 1, from the situation shown in FIG. 1, which is also the situation shown in FIG. 2A. The situation shown in FIG. 2F corresponds to chamber $V_4$ passing through its maximum volume. These views in particular allow for the development of the chamber, which forms at point $B_N$ in FIG. 2A, to be followed. It can also be seen how chamber $V_9$ in FIG. 2A disappears at bifurcation point $B_N$ in FIG. 2C.

Figure 3:
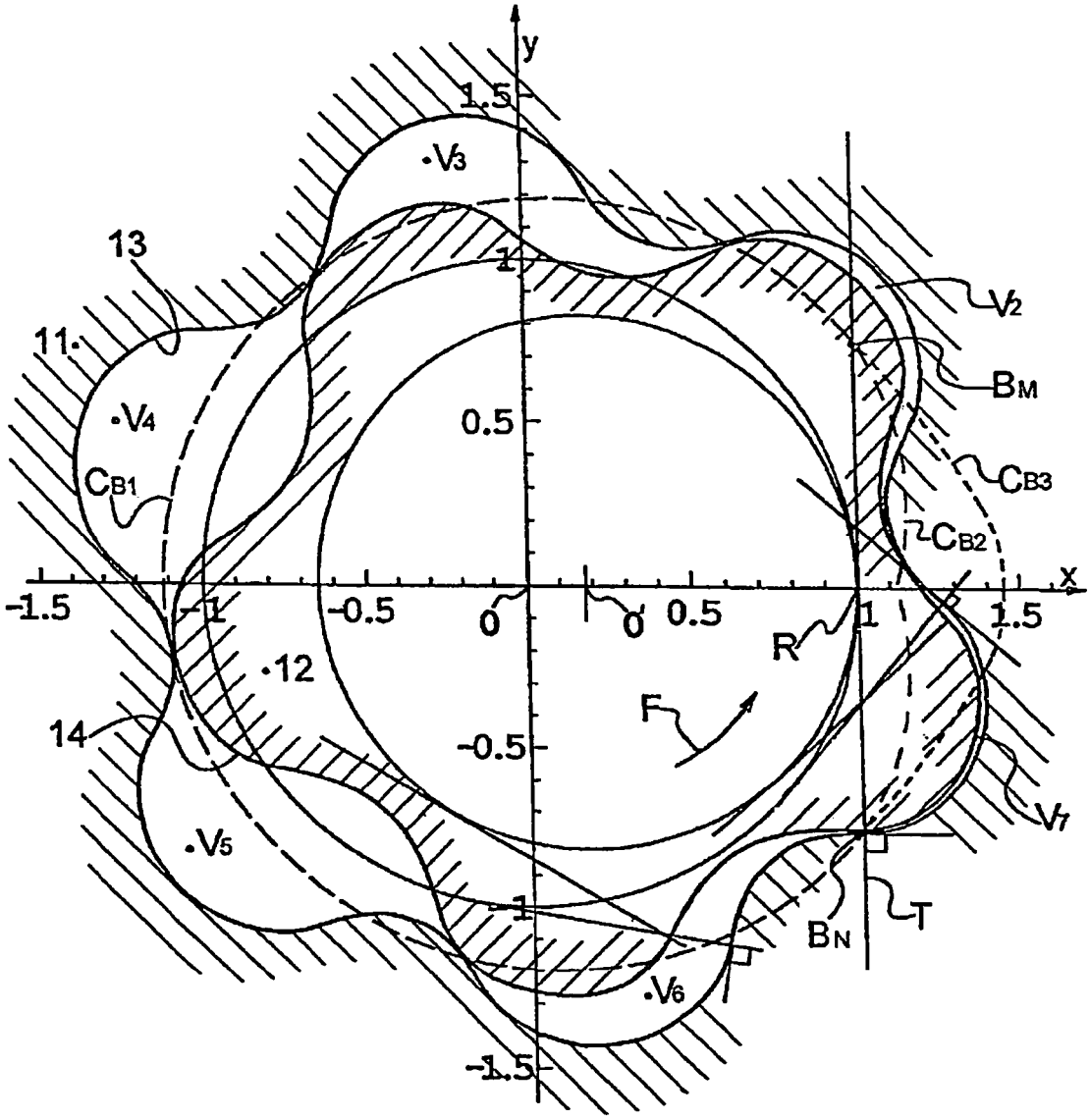
FIG. 3 is a view analogous to FIG. 1 but relating to a machine in the second class.

The example in FIG. 3 will only be described in terms of its differences relative to the example in FIG. 1.

The m-lobed profile 13 is now outside the (m−1)-lobed profile 14, and belongs to a profiled member 11 that is outside and surrounds the profiled member 12 with the (m−1)-lobed profile 14.

This time, there are two curves of action $CB_2$ and $CB_3$ radially beyond the rolling point R and a single curve of action $CB_1$ on the other side of the tangent T. The curves of action are concurrent at bifurcation points $B_N$ and $B_M$ situated on the common tangent T as previously, except that the bifurcation $B_N$, which corresponds to the appearance of the chambers, is now situated higher up relative to the direction F of rotation taken as an example, relative to the bifurcation $B_M$, which corresponds to the disappearance of the chambers. Beyond point $B_M$, the chambers $V_2$, $V_3$ and $V_4$ are all growing and then the chambers $V_5$, $V_6$ and $V_7$ are shrinking whilst a new growing chamber is appearing by osculation at point $B_N$ in the situation shown. There is therefore only alternation of growing and shrinking chambers radially beyond the tangent T. There are fewer points of contact than in the machine in the first class in FIGS. 1 and 2A to 2F.

Figure 4A:
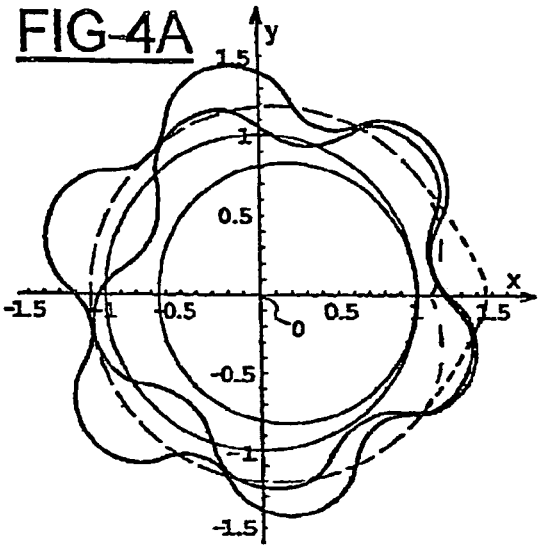
FIGS. 4A to 4F are views analogous to FIG. 3, but on a smaller scale, showing six successive states of the machine.
Figure 4B:
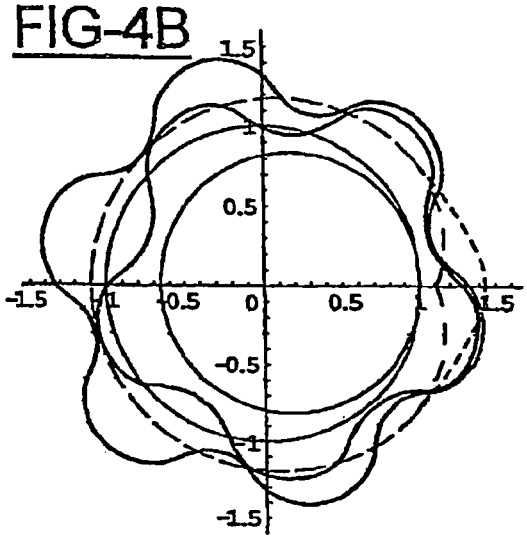
Figure 4C:
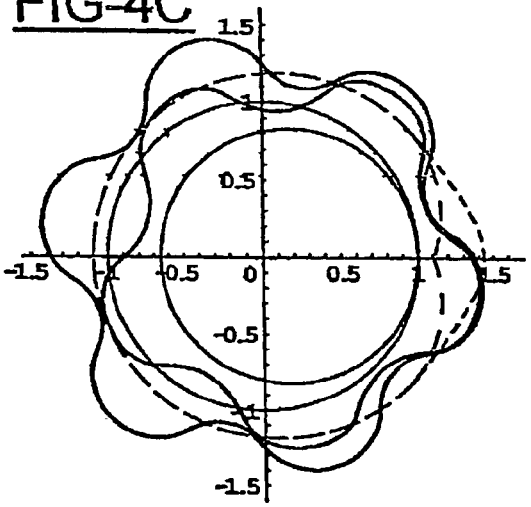
Figure 4D:
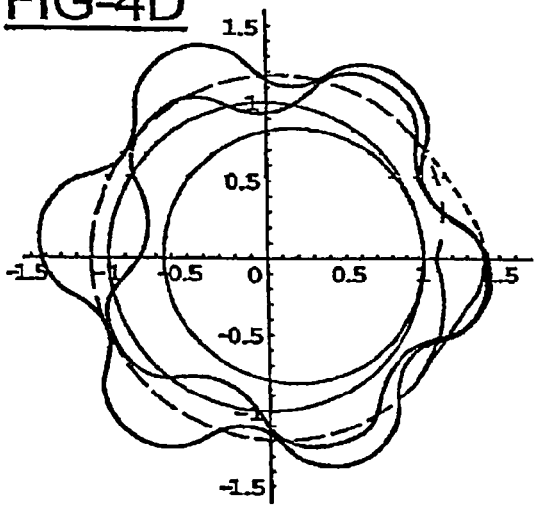
Figure 4E:
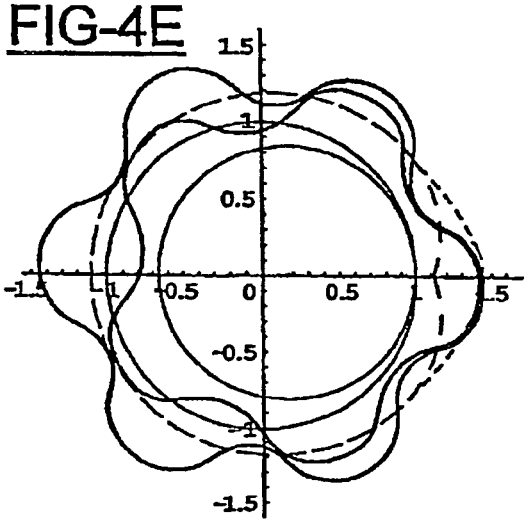

FIGS. 4A to 4F show six successive states of the machine in FIG. 3, from the situation shown in FIG. 3, which is also the situation shown in FIG. 4A.

Figure 4F:
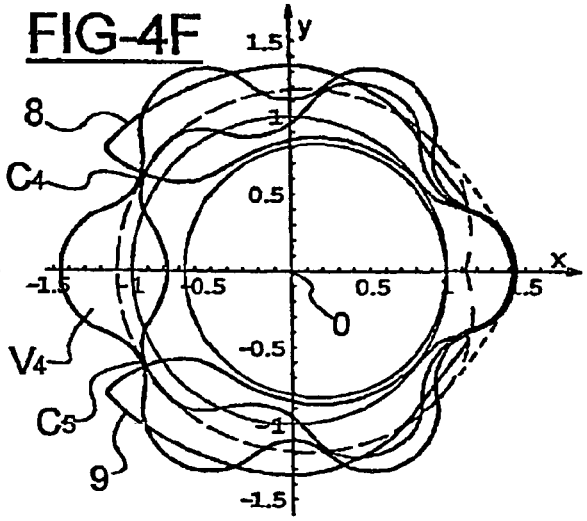
Figure 6A:
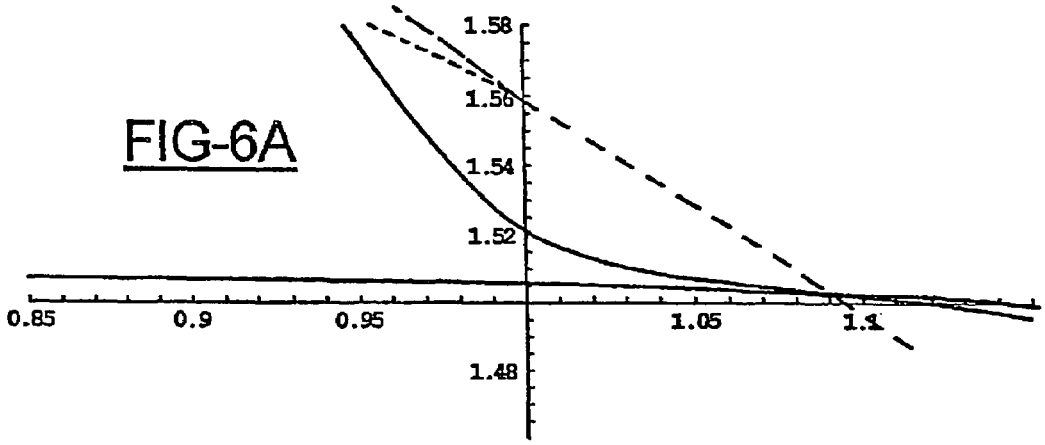
FIGS. 6A, 6B and 6C show the large-scale detail of the profiles passing through osculation, in the example in FIG. 1, FIG. 6B relating to the osculation, and FIGS. 6A and 6C being offset by a rotation of three degrees of the inner profile in either direction.
Figure 6B:
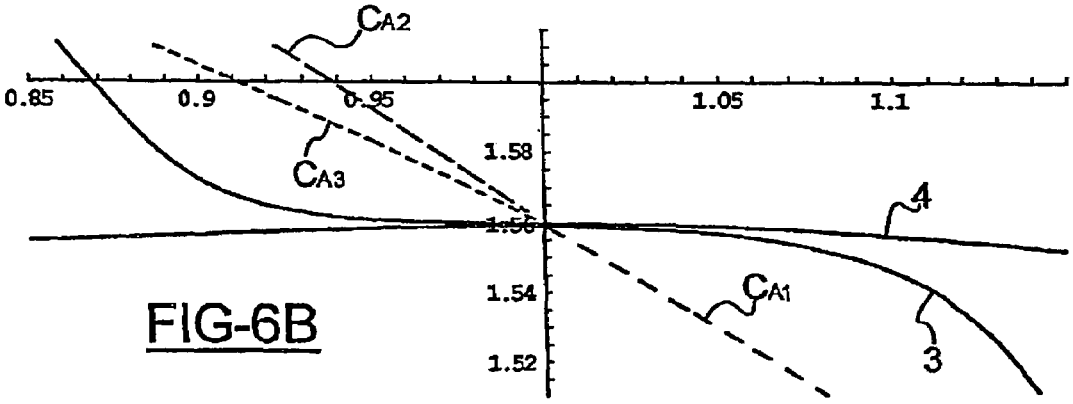
Figure 6C:
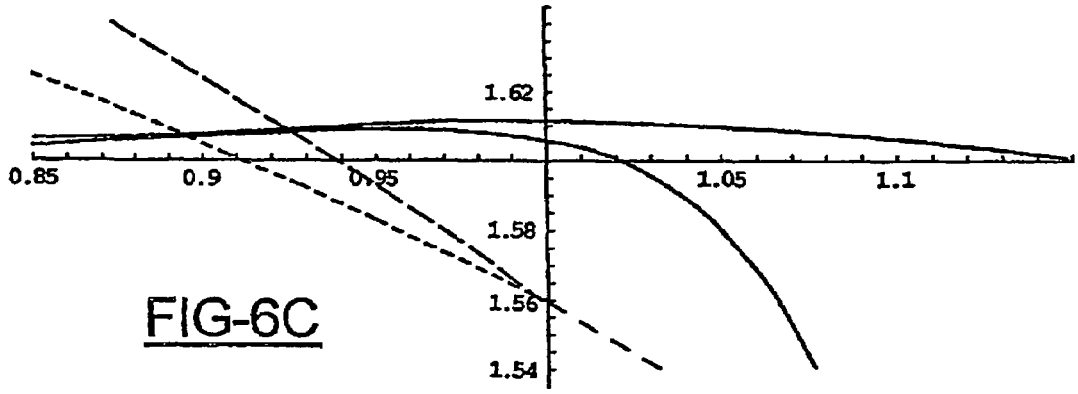
Figure 7A:
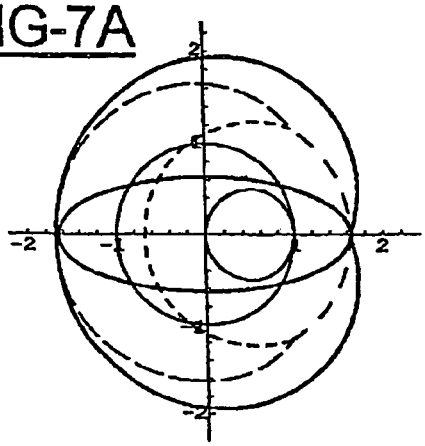
FIGS. 7A and 7B show, in two different states, a machine in the first class according to the invention with a bi-lobed inner profile.
Figure 7B:
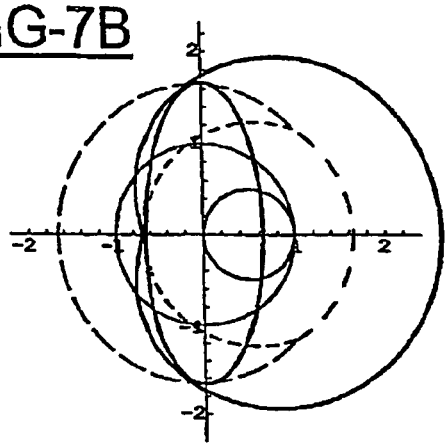
Figure 8A:
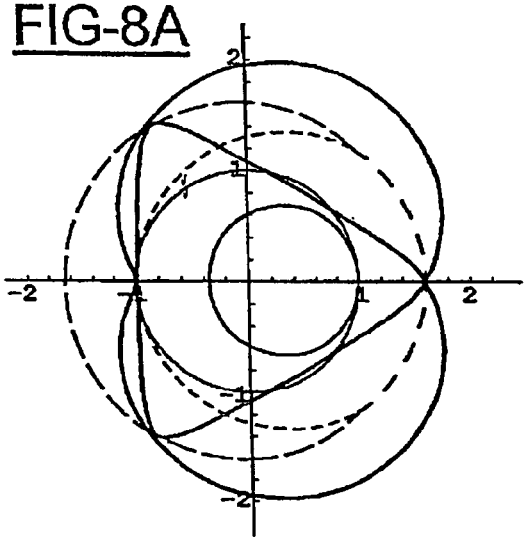
FIGS. 8A and 8B show, in two different states, a machine in the first class according to the invention with a tri-lobed inner profile.
Figure 8B:
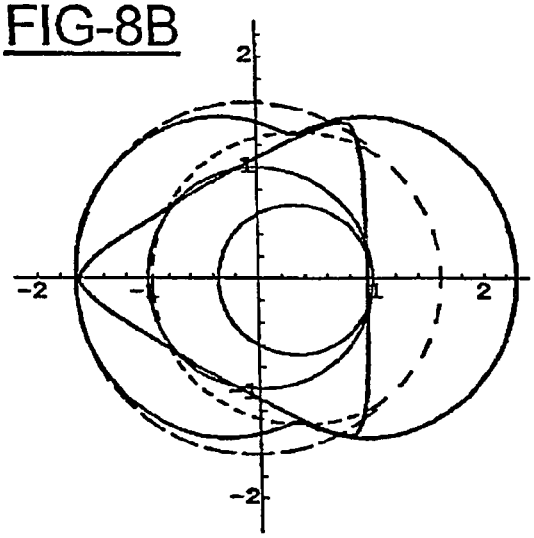
Figure 9A:
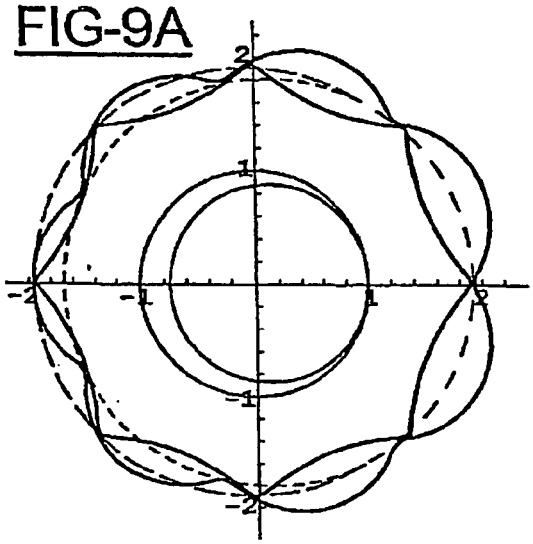
FIGS. 9A and 9B show, in two different states, a machine in the first class according to the invention with an eight-lobed inner profile.
Figure 9B:
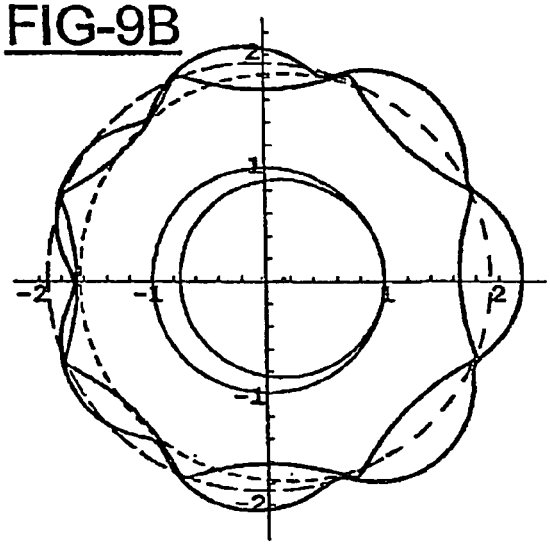
Figure 10A:
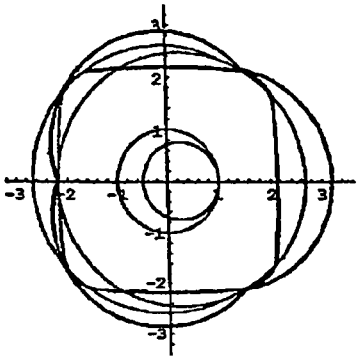
FIGS. 10A to 10I show nine different geometries for a machine in the first class according to the invention, with a four-lobed inner profile.
Figure 10B:
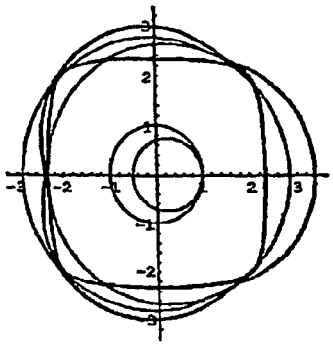
Figure 10C:
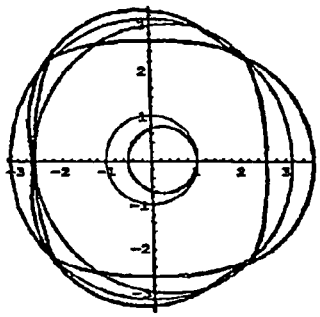
Figure 10D:
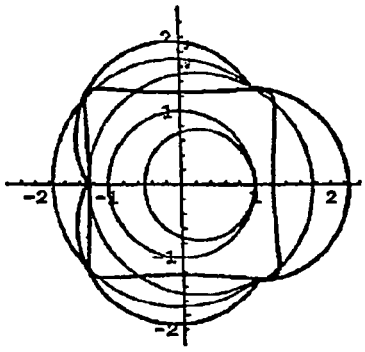
Figure 10E:
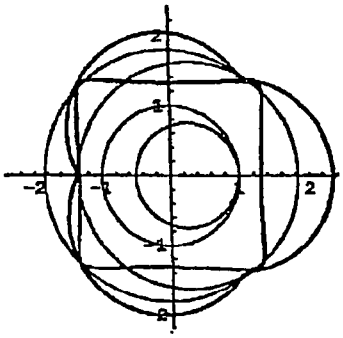
Figure 10F:
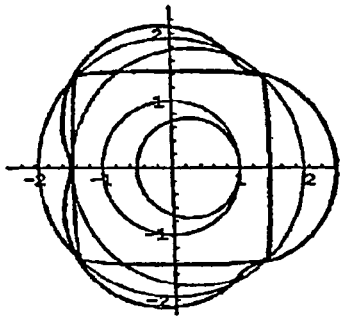
Figure 10G:
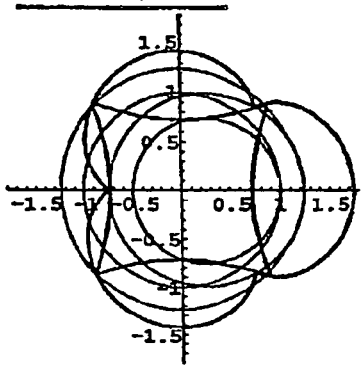
Figure 10H:
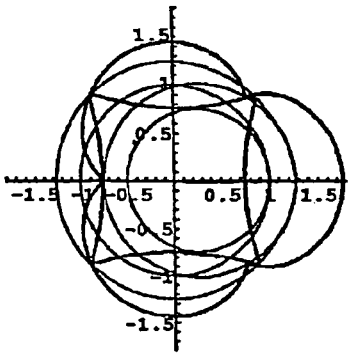
Figure 10I:
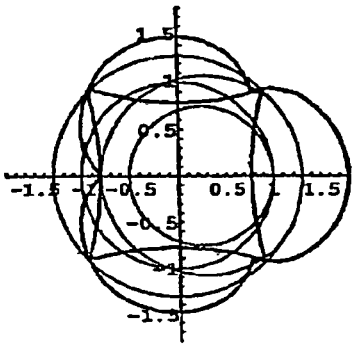

In the situation shown in FIG. 4F, the chamber $V_4$ has reached a position in which it is symmetrical relative to the axis Ox so that the direction of change in its volume is changing. This is why this figure also shows inlet ports 8 and discharge ports 9 made through a flange which, moreover, laterally closes the chambers. The chamber $V_4$ does not communicate with the port 8 or the port 9. The chambers in the growth phase communicate with the port 8, which extends to the rear point of contact $C_4$ of the chamber $V_4$. The chambers in the shrinkage phase communicate with the discharge port 9, which starts from the front point of contact $C_5$ of the chamber $V_4$. The flange(s) in which the ports 8, 9 are made is/are securely attached to the connecting member represented by the reference Oxy.

Figure 5:
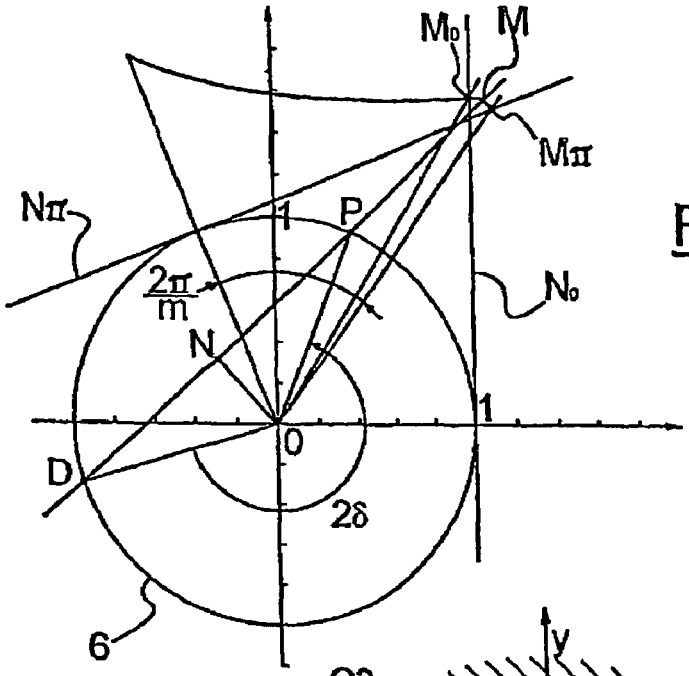
FIG. 5 is a geometric construction illustrating the determining of the parameters of the profiles according to the invention.

The specific parameterisation allowing for the implementation of the geometric profile definitions according to the invention will now be described with reference to FIG. 5.

The circle with a centre 0 and a radius 1, intended to form the pitch circle of the m-lobed profile, is considered in the Euclidean plane. The arc $M_0M_\pi$ is chosen arbitrarily; in the example in FIG. 5 it is shown as identical to the dome of a lobe of the profile 3, including with regard to its distance and orientation relative to the centre O, and a radius issuing from this centre. The expression "is chosen arbitrarily" is not given to mean that any arc will do, and necessary conditions that this choice must meet will be given below. Apart from the types of arc to be ruled out, the shape and dimension of the arc can also be chosen, together with its position relative to the centre O depending on desiderata relating to the geometry sought, taking into account for example the different examples of geometry shown and described below. The arc $M_0M_\pi$ is known as the "given arc", and any point on the given arc is known as M. One of the characteristics that the given arc must have is that its normals $N_0$ and $N_\pi$ to the extremities $M_0$ and $M_\pi$ are tangent to two different points of the pitch circle 6.

The two intersections of the normal to the arc at M with the pitch circle 6 are known as P and D, point P being situated between M and D. The middle of the segment PD is further known as N. The angle DOP, measured clockwise between 0 and $2\pi$, is known as $2\delta$, so that $\delta$ is between 0 and $\pi$. The polar angle of P minus $\delta$, which is also the polar angle of D plus $\delta$ is known as $\sigma$. It can be seen that for $\delta<\pi/2$, $\sigma$ is the polar angle of N and that for $\delta>\pi/2$, $\sigma$ is the polar angle of the point of symmetry of N relative to the origin O.

Finally, the distance MN counted positively is known as $\rho$.

The values ($\delta$, $\sigma$, $\rho$) are defined univocally by the point M. Reciprocally, the point M is defined univocally by these values; the half-line with origin O and polar angle $\sigma$ is constructed, and then the points P and D by taking the angles $\pm\delta$ from this half-line. The point N is the middle of the segment PD and M is constructed by plotting the length MN=$\rho$ on the straight line PD from the side of P.

The given arc is chosen as being a differentiable arc on which the angle $\delta$ is a coordinate between 0 and $\pi$. This means that when the point M moves along the arc, the angle $\delta$ associated with it takes each value between 0 and $\pi$ once and once only. We are therefore interested in arcs the normal of which regularly brushes (from a tangent $N_0$ to a tangent $N_\pi$) the pitch circle, when they are moved along from the origin to the extremity. These arcs form two classes in the relative direction of travel and brushing, and these two classes are associated with the two aforementioned classes of conjugate profiles and therefore of machines.

In choosing $\delta$ as a parameter along the arc, the arc is characterised by the two functions $\rho(\delta)$ and $\sigma(\delta)$. These two functions are not independent; they are connected by the following relationship between their derivatives $\rho'(\delta)$ and $\sigma'(\delta)$ relative to $\delta$:

$$\sigma'(\delta)\cos(\delta)=\rho'(\delta)$$

The addition of a constant to the function $\sigma(\delta)$ corresponds to an overall rotation of the arc around the origin O. Because in conjugation problems, we are interested in arcs defined to within such a rotation, it is natural to characterise the arcs by the function $\rho(\delta)$, with the function $\sigma(\delta)$ being deduced by the quadrature:

$$\sigma(\delta)=\int_{\delta 0}^{\delta}\frac{\rho'(\tau)d\tau}{\cos(\tau)}$$

this integration being carried out from $\tau=\delta_0$ to $\tau=\delta$, where $\tau$ is a dummy variable of integration and the arbitrary on the constant of integration $\delta_0$ corresponds to an arbitrary rotation of the arc around the origin O.

With these definitions, the Cartesian coordinates ($x(\delta)$, $y(\delta)$) of an arc defined by the function $\rho(\delta)$ and a choice of the constant in $\sigma(\delta)$ are written:

$$x(\delta)=\cos(\delta)\cos(\sigma(\delta))+\sigma(\delta)\sin(\sigma(\delta))$$

$$y(\delta)=\cos(\delta)\sin(\sigma(\delta))+\rho(\delta)\cos(\sigma(\delta))$$

Given an arc defined as above by the function $\rho(\delta)$ and an integer $m\geqq 2$, its four associated arcs are defined by the following expressions:

proximal conjugate arc:

$$x_{CjP}(\delta)=\left(1+(\sin(\delta)-m\rho(\delta))\sin\left(\frac{\delta-m\sigma(\delta)}{m-1}\right)+(m-1)\cos(\delta)\cos\left(\frac{\delta-m\sigma(\delta)}{m-1}\right)\right)\Big/m$$

$$y_{CjP}(\delta)=\left((\sin(\delta)-m\rho(\delta))\cos\left(\frac{\delta-m\sigma(\delta)}{m-1}\right)-(m-1)\cos(\delta)\sin\left(\frac{\delta-m\sigma(\delta)}{m-1}\right)\right)\Big/m$$

distal conjugate arc:

$$x_{CjD}(\delta)=\left(1+(\sin(\delta)-m\rho(\delta))\sin\left(\frac{\delta+m\sigma(\delta)}{m-1}\right)+(m-1)\cos(\delta)\cos\left(\frac{\delta+m\sigma(\delta)}{m-1}\right)\right)\Big/m$$

$$y_{CjD}(\delta)=\left(-(\sin(\delta)+m\rho(\delta))\cos\left(\frac{\delta+m\sigma(\delta)}{m-1}\right)+(m-1)\cos(\delta)\sin\left(\frac{\delta+m\sigma(\delta)}{m-1}\right)\right)\Big/m$$

proximal complementary arc:

$$x_{CpP}(\delta)=\left((2\sin(\delta)-m\rho(\delta))\sin\left(\frac{2\delta}{m}-\sigma(\delta)\right)+m\cos(\delta)\cos\left(\frac{2\delta}{m}-\sigma(\delta)\right)\right)\Big/m$$

$$y_{CpP}(\delta)=\left((2\sin(\delta)-m\rho(\delta))\cos\left(\frac{2\delta}{m}-\sigma(\delta)\right)-m\cos(\delta)\sin\left(\frac{2\delta}{m}-\sigma(\delta)\right)\right)\Big/m$$

distal complementary arc:

$$x_{CpD}(\delta)=\left((2\sin(\delta)+m\rho(\delta))\sin\left(\frac{2\delta}{m}+\sigma(\delta)\right)+m\cos(\delta)\cos\left(\frac{2\delta}{m}+\sigma(\delta)\right)\right)\Big/m$$

$$y_{CpD}(\delta)=\left(-(2\sin(\delta)+m\rho(\delta))\cos\left(\frac{2\delta}{m}+\sigma(\delta)\right)+m\cos(\delta)\sin\left(\frac{2\delta}{m}+\sigma(\delta)\right)\right)\Big/m$$

A pair of conjugate profiles is defined from a given arc defined by the function $\rho(\delta)$ and the associated arcs.

As mentioned above, there are two classes of such profiles, which correspond to the two relative directions of brushing of the circle by the normal to the given arc, moving along this arc.

These two classes are very simply characterised by the sign of the derivatives $\rho'(0)$ and $\rho'(\pi)$.

One of the profiles is generated by the concatenation (that is, placing end to end whilst keeping the relative orientation) of the given arc and one of the complementary arcs: this is the complemented profile; the other is generated by the concatenation of the two conjugate arcs: this is the conjugate profile.

The given arc is in the first class when: $\rho'(0)>0$ and $\rho'(\pi)<0$.

An examination of the regularity of the connections shows that the following is more specifically required:

$$1/m>\rho'(0)>0 \text{ and } -1/m<\rho'(\pi)<0$$

In this case, the complemented profile is formed by the concatenation of the given arc and the proximal complementary arc, repeated by rotations of $2\pi/m$ around the origin. The profile is of order m, i.e. is unchanged when it is rotated by $2\pi/m$ (around the origin)and it has m lobes or teeth. This is the profile shown partly in FIG. 5.

The conjugate profile is formed by the concatenation of the proximal conjugate arc and the distal conjugate arc, repeated by rotations of $2\pi/(m-1)$ around the centre O' with coordinates (1/m, 0). The profile is of order (m −1), in the same direction as previously. The ratio of the rotation speeds is (m−1)/m.

The complemented profile is inside the conjugate profile.

The given arc is in the second class when: $\rho'(0)<0$ and $\rho'(\pi)>0$.

An examination of the regularity of the connections shows that the following is more specifically required:

$$-1/m<\rho'(0)<0 \text{ and } 1/m>\rho'(\pi)>0$$

In this case, the complemented profile is formed by the concatenation of the given arc and the distal complementary arc, repeated by rotations of $2\pi/m$ around the origin. The profile is of order m.

The conjugate profile is formed, as for the first class, by the concatenation of the proximal conjugate arc and the distal conjugate arc, repeated by rotations of $2\pi/(m-1)$ around the centre O' with coordinates (1/m, 0). The profile is of order (m−1). The ratio of the rotation speeds is (m−1)/m.

The complemented profile is outside the conjugate profile.

The inequalities relating to $\rho'(0)$ and $\rho'(\pi)$ are strict. This point controls the continuity of the curvature of the profiles at the connections between the arcs.

These inequalities are necessary and sufficient for the regularity of the connections, but do not ensure the regularity of the arcs themselves, which must be examined elsewhere. In other words, any $\rho(\delta)$ function does not necessarily lead to a pair of regular conjugate profiles.

Below is some information about regularity at the inner points of the associated arcs.

It can be demonstrated that the only singularities likely to appear on the arcs associated with a regular given arc are of the swallowtail type: two cusps surrounding a self-intersection. The condition for this not to occur is simply that the speed vector (vector derived from the current point on the arc relative to the parameter) is not cancelled over the interval $]0,\pi[$. These four speeds (corresponding to the four arcs from which the two profiles are formed) are expressions dependent on $\delta$, $\rho(\delta)$ and the derivative $\rho'(\delta)$. The nonvanishing of these expressions is therefore a constraint on the function $\rho(\delta)$. This constraint must be approached from the angle of verification, unless the systems of non-linear differential inequations can be solved. For the given arc, the condition on the amplitude of the speed is written:

$$V(\delta)=(\rho(\delta)\rho'(\delta))/\cos(\delta)-\sin(\delta)\neq 0$$

and this condition simply expresses that the quotient by $\cos(\delta)$ of the derivative of the square of the radius vector keeps a constant sign.

The corresponding expressions for the associated arcs are less simple. They are as follows:

for the proximal complementary arc:

$$V_{CpP}(\delta)=(m\rho(\delta)-2\sin(\delta))\rho'(\delta)/(m\cos(\delta))-(2m\rho(\delta)+(m^2-4)\sin(\delta))/m^2\neq 0$$

for the distal complementary arc:

$$V_{CpD}(\delta)=(m\rho(\delta)+2\sin(\delta))\rho'(\delta)/(m\cos(\delta))-(2m\rho(\delta)-(m^2-4)\sin(\delta))/m^2\neq 0$$

for the conjugate arcs:

$$V_{CjP}(\delta)=(m\rho(\delta)-\sin(\delta))\rho'(\delta)/((m-1)\cos(\delta))-(\rho(\delta)+(m-2)\sin(\delta))/(m-1)\neq 0$$

$$V_{CjD}(\delta)=(m\rho(\delta)+\sin(\delta))\rho'(\delta)/((m-1)\cos(\delta))+(\rho(\delta)-(m-2)\sin(\delta))/(m-1)\neq 0$$

An interesting family of pairs of profiles in the first class is obtained from arcs of curtate (or contracted) epicycloids. These are in fact typical solutions, more than an example.

These arcs depend on three parameters: n is the order of the epicycloid, which can be chosen as real (positive and not too small), $\phi$ is an angular parameter of between 0 and $\pi/2$, which describes the contraction of the curtate epicycloid, and finally $\rho_0$ is the parallelism parameter, that is, a parameter characterising the distance to the base epicycloid. The calculation of $\rho(\delta)$ and $\sigma(\delta)$ gives:

$$\rho(\delta)=(1-1/n)(1/\cos(\phi)^2)-\cos(\delta)^2)^{1/2}+(1/n)\sin(\delta)+\rho_0$$

$$\sigma(\delta)=(1-1/n)\arccos(\cos(\delta)\cos(\phi))+(\delta/n)$$

The best osculation of the profiles is found for n close to 2 m−2; $\rho_0$ must not be too far from 0; small $\phi$s correspond to fine teeth and when ($\phi$tends towards $\pi/2$, the profiles become rounder and larger without limitation; reasonable values for $\phi$ are around $\pi/3$ or $\pi/4$.

A family of examples of profiles in the second class is similarly provided by:

$$\rho(\delta)=(1+1/n)\,(1/\cos(\phi)^2-\cos(\delta)^2)^{1/2}-(1/n)\sin(\delta)-\rho_0$$

$$\sigma(\delta)=(1+1/n)\arccos(\cos(\delta)\cos(\phi))-(\delta/n)$$

The variability of the parameters (before a singularity is encountered) is greater than in the previous case, particularly with regard to $\rho_0$.

To sum up, the given arc must have the following property: when it is moved along from its origin to its extremity, its normal "regularly brushes" the pitch circle, and in particular, the normals to the origin and the extremity of the arc are tangent to the pitch. The possible arcs are split into two disjoint classes: those with a normal that brushes the pitch circle "in the opposite direction" to the current point M and those with a normal that brushes it "in the same direction" as the current point M.

The two classes of solutions already discussed with regard to the problem of maximum inner conjugation correspond to these two possibilities. The first class is made up of pairs of profiles such that the inner profile has one more lobe than the outer profile; the second class, conversely, is such that the inner profile has one lobe fewer than the outer profile. These two classes have very different morphologies and properties as described above.

In general, the formulae obtained for the arcs are nonsingular, in that the family of the four arcs that define the two profiles can be constructed from any one of them. This does not mean that they play completely symmetrical roles: in fact, of the two arcs that form each profile, one of the two comes into contact with both arcs of the other profile, and the other with just one of them. Such is the maximum conjugation, as a result of which the curves of action are formed from three arcs concurrent at two bifurcation points $B_M$ and $B_N$. The contact passes through these "triple points" at the connection between the two arcs that form each of the two profiles.

The parameterisation according to the invention has allowed for simple mathematical expressions for the curves of action to be determined for the machines according to the invention, namely:

the contact between the given arc and its proximal conjugate is the proximal curve of action, with the following equation:

$$x(\delta)=1-\sin(\delta)(\sin(\delta)-\rho(\delta))$$

$$y(\delta)=\cos(\delta)(\sin(\delta)-\rho(\delta))$$

the contact between the given arc and its distal conjugate is the distal curve of action, with the following equation:

$$x(\delta)=1-\sin(\delta)(\sin(\delta)+\rho(\delta))$$

$$y(\delta)=-\cos(\delta)(\sin(\delta)+\rho(\delta))$$

the contact between the proximal complementary of the given arc and its proximal conjugate is the proximal complementary curve of action, with the following equation:

$$x(\delta)=1-\sin(\delta)(((m-2)/m)\sin(\delta)+\rho(\delta))$$

$$y(\delta)=-\cos(\delta)(((m-2)/m)\sin(\delta)+\rho(\delta))$$

the contact between the distal complementary of the given arc and its distal conjugate is the distal complementary curve of action, with the following equation:

$$x(\delta)=1-\sin(\delta)(((m-2)/m)\sin(\delta)-\rho(\delta))$$

$$y(\delta)=-\cos(\delta)(((m-2)/m)\sin(\delta)+\rho(\delta))$$

These four arcs are concurrent at points $\delta=0$ and $\delta=\pi$. The proximal and distal complementary curves of action pass radially beyond the rolling point R, and the other two on the other side of the origin O relative to the rolling point R. Only three of these four curves of action intervene: the distal complementary curve of action is absent for the first class, for which the distal complementary arc does not intervene, and the proximal complementary curve of action is absent from the second class, for which the proximal complementary arc does not intervene.

FIGS. 7A, 7B, 8A, 8B, 9A and 9B show different embodiments of machines in the first class. It appears that when the number of lobes is small, for example 2 or 3, the lobe hollows are simply less protruding areas, the profile of which can even be convex with regard to the inner profiled member.

In the very specific case in which the (m−1)-lobed profile only has one lobe (FIGS. 7A and 7B), the lobe vertex and the lobe hollow are diametrically opposed, if the profile is symmetrical.

FIGS. 10A to 10I show nine variants of geometries for a four-lobed inner profile in a three-lobed profiled outer member.

Figure 11A:
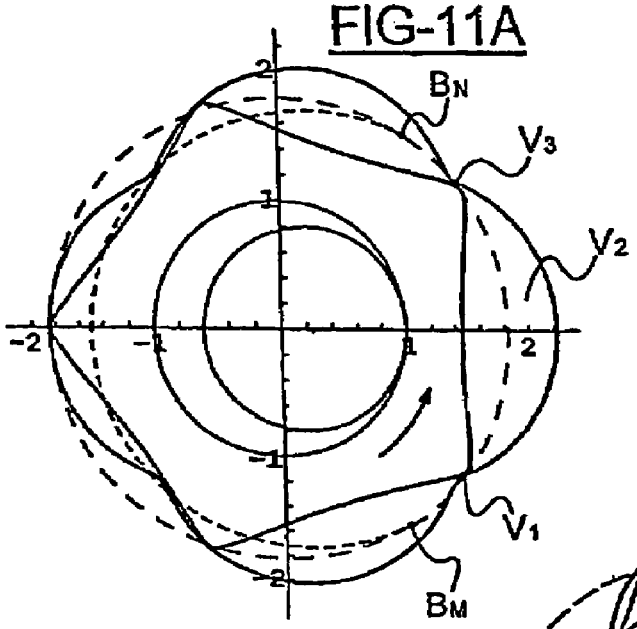
FIGS. 11A, 11B and 11C show three different geometries for a machine in the first class according to the invention, with a five-lobed inner profile.
Figure 11B:
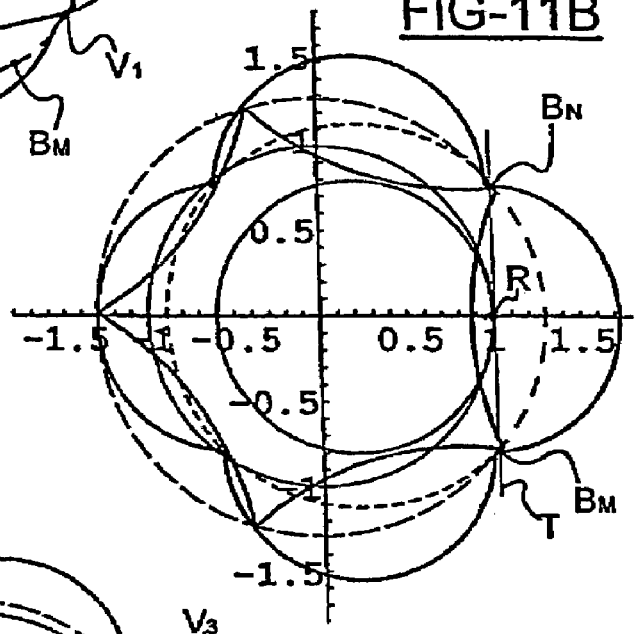
Figure 11C:
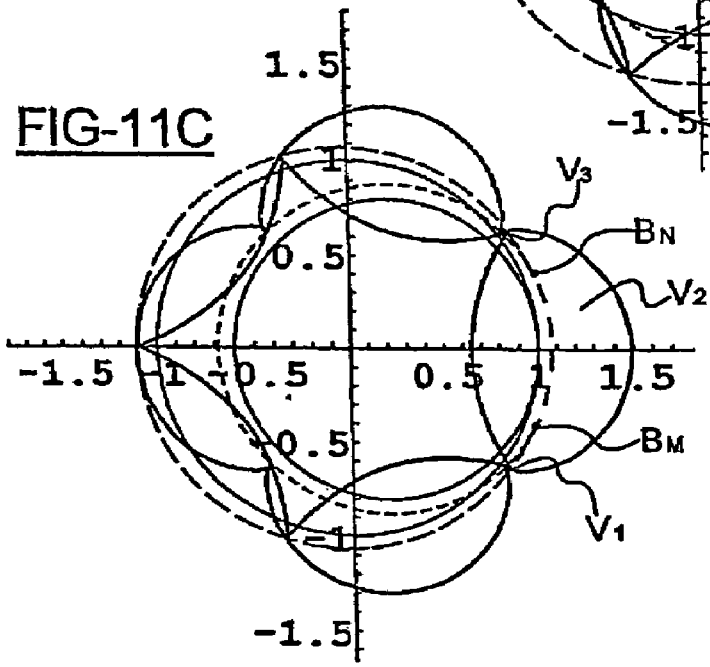

FIGS. 11A to 11C show three examples of a machine in the first class with a five-lobed inner rotor.

The embodiment in FIG. 11B is characterised by the fact that the two osculating contacts occur simultaneously, on either side of a chamber $V_1$, the volume of which is then at its maximum.

By comparison, the embodiment in FIG. 11A is analogous to the embodiment in FIG. 1, in that a chamber $V_2$ the rear edge of which has passed the bifurcation point $B_M$ and behind which a chamber $V_1$ has therefore disappeared, has not yet reached with its front edge the other bifurcation point $B_N$, at which a future new chamber $V_3$ will appear in front of it, which is therefore only shown with a dashed line.

Conversely, in the embodiment in FIG. 11C, the same chamber $V_2$ covers both bifurcation points $B_N$, $B_M$ at the same time, so that it is still followed by a disappearing chamber $V_1$ and is already preceded by an appearing chamber $V_3$.

A method of distribution for a machine, in particular a hydraulic machine, in the first class, will now be described with reference to FIG. 12.

Figure 12A:
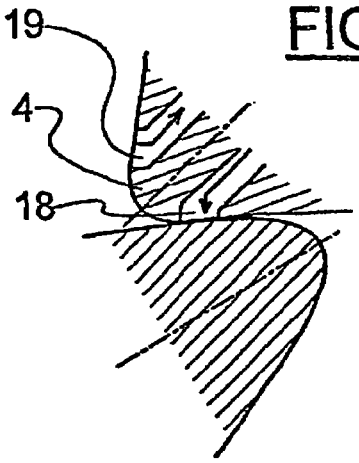
FIG. 12A is a detailed view showing a variant for the distribution system in the embodiment in FIG. 12.
Figure 12:
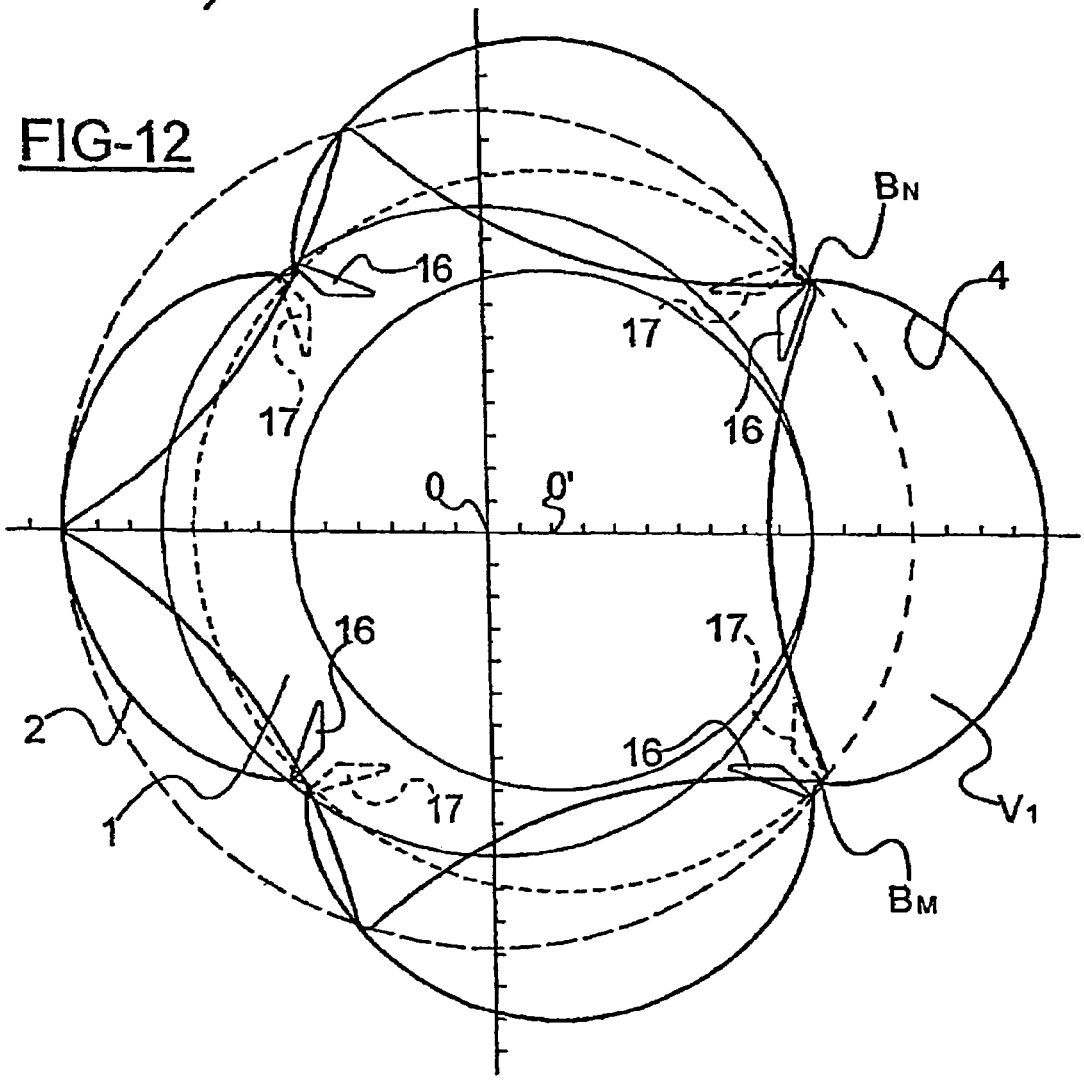
FIG. 12 is a view of the machine in FIG. 11B on an enlarged scale, with schematisation of certain means of distribution.

FIG. 12 relates to the machine in FIG. 11B. It is considered that there is a flange against each radial surface of the profiled members 1 and 2 laterally closing the chambers, with the exception of the ports that will be described. These flanges are firmly rotatably attached to the outer profile 2. In the flange located on the side of the observer in FIG. 12, teardrop- or comma-shaped ports 16, the angular tip of which coincides with the connection of the two arcs forming the outer profile, on the rear side of the lobes, have been formed through the flange (the flange itself is not shown).

From their tip coinciding with the connection of the arcs forming the profile 4, the ports extend generally towards the axes O and O'. These ports 16, depending on whether or not they are covered by the m-lobed profiled member, selectively make the chambers communicate with the intake. In the other flange, located at the axial extremity hidden from the observer in FIG. 12, there are ports 17 that are symmetrical with the ports 16 relative to radii passing through the lobe vertices of the (m−1)-lobed profile 4, and the angular tip of which coincides with the connection between the two arcs forming the (m−1)-lobed profile 4 on the front side of each lobe. The ports 17 communicate with the hydraulic discharge of the machine.

By means of the particularity of the geometry shown, according to which the chamber $V_1$ is adjacent on one side to a disappearing chamber at point $B_M$ and on the other side to a chamber appearing at point $B_N$, the chamber $V_1$ is only isolated for a short instant when its volume is at its maximum and is therefore not varying. In the previous instant, the disappearing chamber was still communicating with the neighbouring discharge port 17 whilst the chamber $V_1$ was communicating with the inlet port 16. In the next instant, the new chamber will communicate with the corresponding inlet port 16, whilst the chamber $V_1$ will communicate with the discharge port 17.

FIG. 12A shows that instead of or in addition to the ports 16 and 17, inlet channels 18 and discharge channels 19 can also be provided in the (m−1)-lobed profiled member, opening through the respective sides of the lobes of the outer profile 4, approximately at the connections between the two arcs forming the profile 4 so that they are closed when the profiles are in osculating contact and are then progressively opened by the chamber forming between the two contacts resulting from the disintegration of the osculating contact, in the case of the appearance of a chamber for the intake, or are progressively closed with regard to the discharge, in the case of the disappearance of a chamber.

Figure 13:
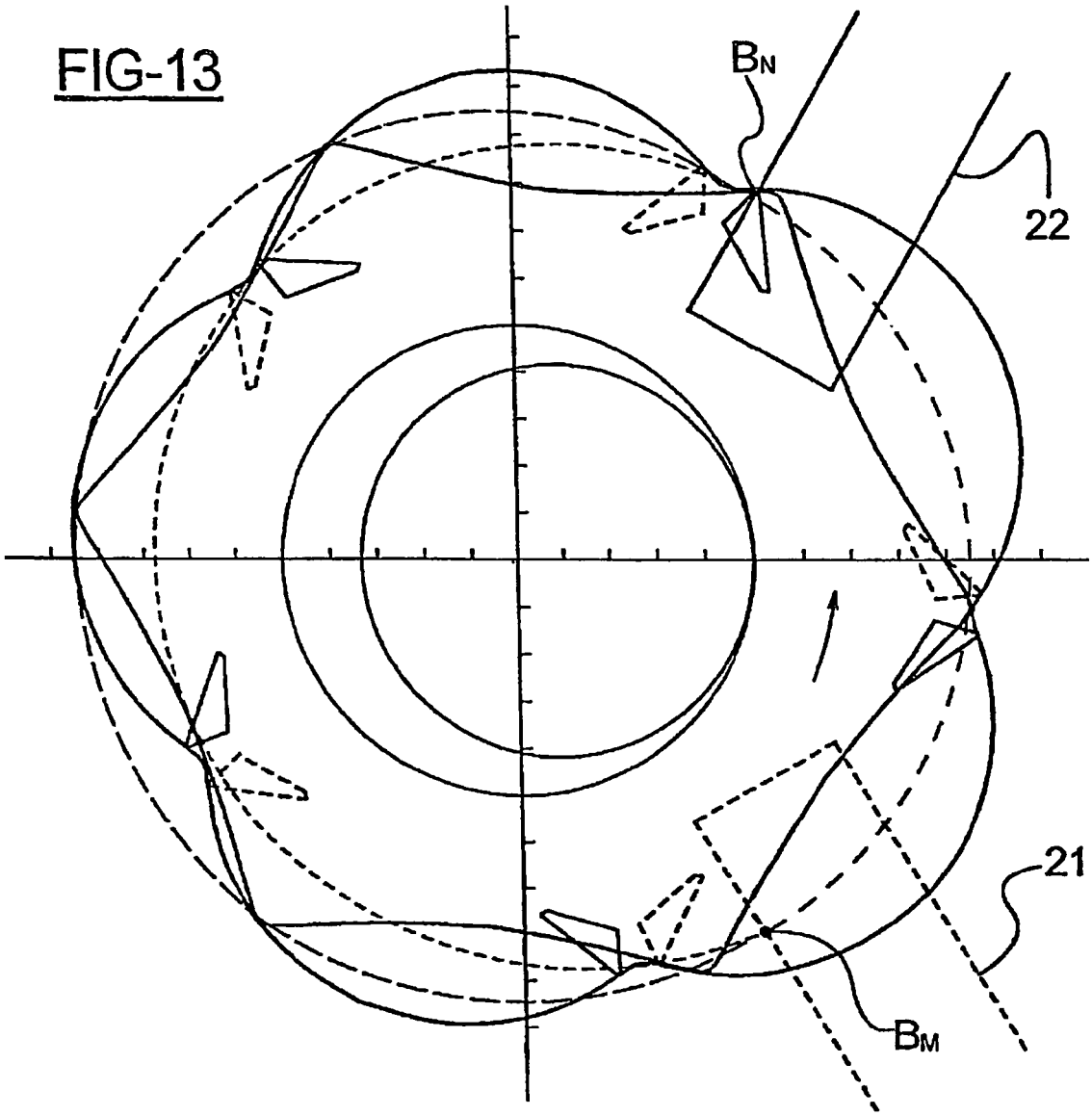
FIG. 13 is an analogous view to FIG. 12 but relative to the machine in FIG. 1.

In the example shown in FIG. 13, the machine has a geometry corresponding to the geometry in FIG. 1, apart from the number of lobes. The situation is also the situation shown in FIG. 11A, but when the profiled members 1 and 2 are at a different angle around their respective axes.

The situation shown in FIG. 13 corresponds approximately to the situation in FIG. 2A. Looking at FIG. 2D, it can be seen that the chamber $V_4$, the rear edge of which has already passed bifurcation point $B_M$ and would consequently already be communicating with the discharge port in a distribution system according to FIG. 12, has still not reached point $B_N$ and would therefore still be communicating with the inlet port of such a distribution system, which is moreover necessary as the volume of the chamber $V_4$ is still growing. It is therefore the communication with the discharge port that must be eliminated. A mask 21 firmly attached to the housing (the connecting member) is therefore provided for in FIG. 13, extending over a certain angular distance forwards relative to the direction of rotation defined by the arrow F, from the bifurcation point $B_M$, to close the discharge port in this area.

For entirely symmetrical reasons, a mask 22 is provided to close the inlet ports over a certain angular area from the bifurcation point $B_N$ backwards relative to the direction of rotation.

In the situation shown in FIG. 1C, the chamber $V_2$ undergoes variations in volume between the time when its front edge covers the bifurcation point $B_N$ and until its rear edge no longer covers the other bifurcation point $B_M$.

In this angular range, the chamber $V_2$ would no longer communicate with any of the ports in a distribution system such as the one in FIG. 12. To overcome this difficulty, additional connections, controlled for example by a cam when a chamber such as $V_2$ passes into this area, or other analogous solutions, are in principle necessary.

Figure 14:
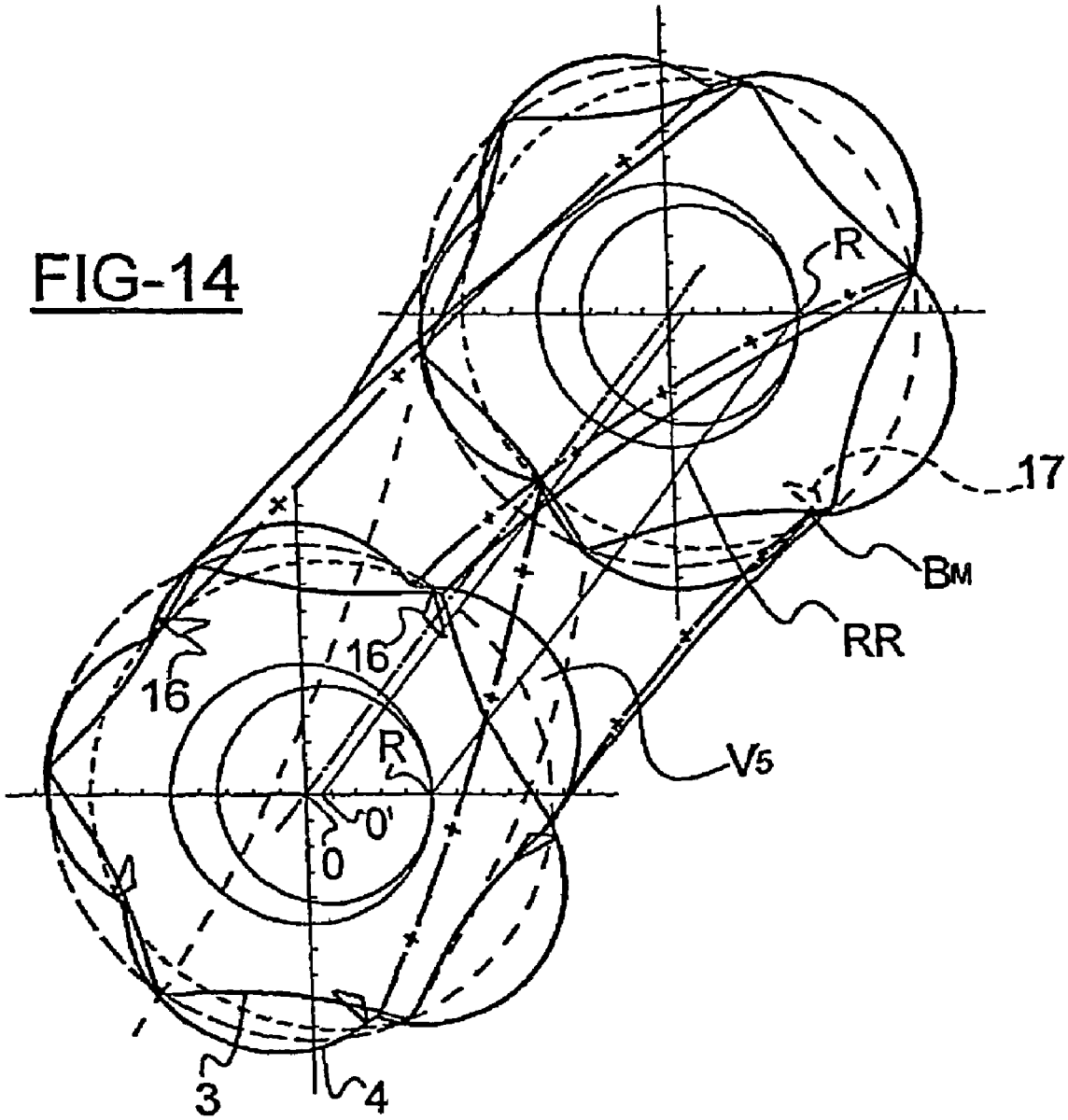
FIG. 14 is a schematic perspective view of a machine in which the profiled members are helical with successive profiles according to FIG. 1.

FIG. 14 shows a particularly preferred embodiment of a machine with a profile according to FIG. 1. The distribution principle is the same as in FIG. 12, and in each plane perpendicular to the axes the profiles 3 and 4 are those in FIG. 1. However, from one plane to another, each profile 3 or 4 is angularly displaced by a given pitch around its respective axis in order to give all of the profiled members a helical appearance. The angular displacement between the profiles of the two extremities is such that in the situation shown, where the chamber $V_5$ on the intake side is reaching the bifurcation point $B_N$, the rear edge of this chamber, which itself has a helical appearance, has just left the other osculation at the other bifurcation point $B_M$. The situation that was obtained by a profile in a single plane in the cases of FIGS. 11B and 12 is therefore restored by means of helicity, namely that the same cavity is adjacent to an appearing cavity at its front edge and a disappearing cavity at its rear edge. This cavity $_5$ is therefore only isolated for a short instant when the instantaneous speed of variation in its volume is equal to zero. In FIG. 14, the vertices of the profile 3 of the profiled inner member are shown with solid lines and some of the vertices of the lobes of the profile of the outer profiled member 4 are shown with a dash and cross line. The centres O and O 'of the profiles of the successive planes are aligned along parallel axes of rotation that are also parallel to a straight line RR on which the rolling points R are aligned.

Figure 15:
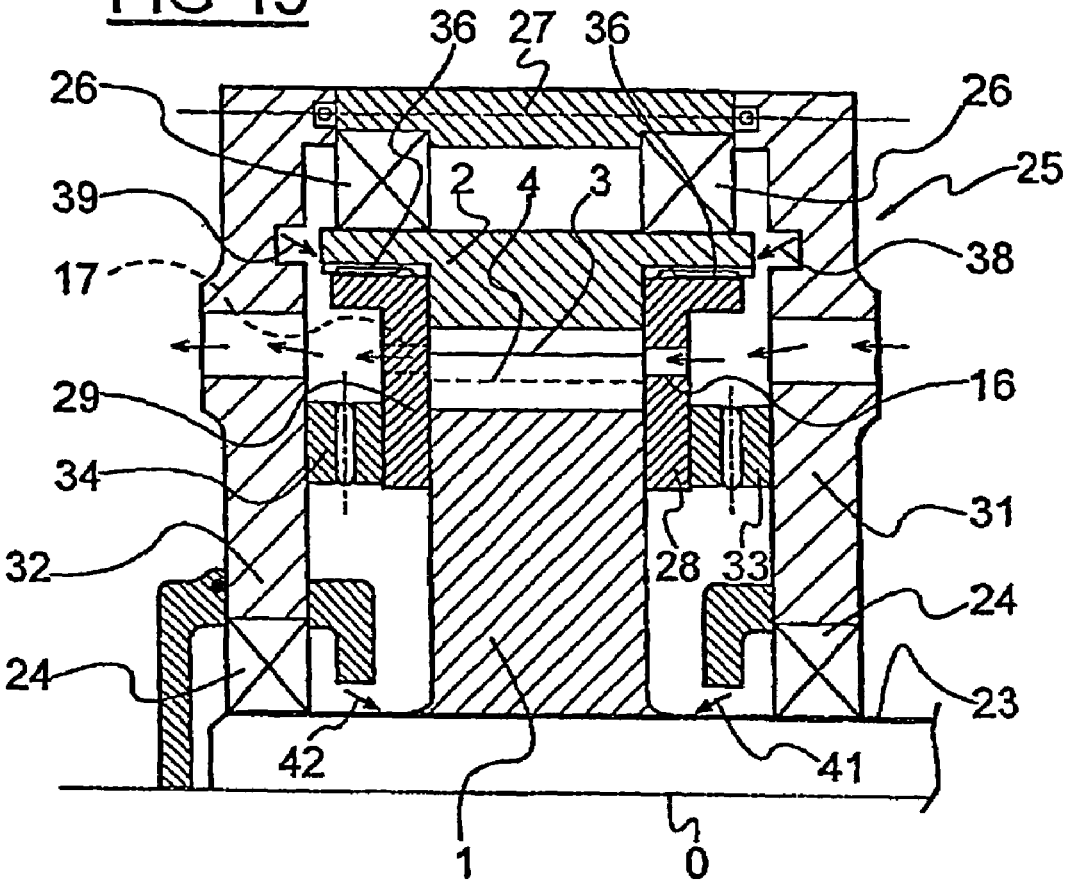
FIG. 15 is a schematic axial sectional half-view of a machine according to the invention.

FIG. 15 schematically shows an embodiment of a machine in the first class according to the invention. The profiled inner member 1 is firmly attached to a drive shaft 23 that is driving in a pump and driven in a hydraulic motor. The shaft 23 is rotatably supported, on either side of the profiled member 1, by two bearings 24 in a fixed housing 25 that forms the connecting member according to the invention. The profiled outer member 2 is rotatably supported by peripheral bearings 26 installed between the outer peripheral wall of the profiled member 2 and a peripheral ring gear 27 forming part of the housing 25. The centre line of the shaft 23 corresponds to the centre O whilst the centre line, not shown, of the bearings 26 corresponds with the centre O'. In the area in which the profiles 3 and 4 are formed, the profiled members 1 and 2 are installed between two flanges 28, 29 through which the inlet ports 16 and discharge ports 17 are respectively formed.

The profiled members 1 and 2 have flat, coplanar end surfaces on which corresponding flat end surfaces of the flanges 28 and 29 rest tightly and slidably in order to close the chambers apart from with regard to the communications established selectively by the ports 16 and 17.

Between each flange 28 or 29 and a corresponding end wall 31 or 32 of the housing, there is a respective axial stop 33, 34. The flanges 28, 29 are connected rotatably with the profiled outer member 2 whilst being translatably free relative to the latter by means of splines 36. The inner space contained between the end wall 31 of the housing on the one hand and the flange 28 and the corresponding surface of the profiled member 1 on the other hand is formed into a chamber subject to the inlet pressure. Similarly, a chamber subject to the discharge pressure is formed between the other end wall 32 of the housing on the [one] hand and the other flange 29 and the other end surface of the profiled inner member 1 on the other hand. These two chambers are closed by dynamic sealing devices 38, 39, 41, 42 that prevent the hydraulic fluid from reaching the bearings 24 and 26, and prevent the two chambers from communicating with each other between the outer profiled member 2 and the ring gear 27 of the housing.

In service, whichever of the two chambers is subject to high pressure (the inlet in the case of a motor and the discharge in the case of a pump) compresses the axial stack formed by the two flanges and the two profiled members 1 and 2 mounted sandwiched between them, resting axially against the axial stop of the opposite chamber. The area exposed to the pressure to provide this axial pressing force is chosen so that the axial thrust is appropriate to achieve a seal between the flanges and the profiled members, but without being excessive.

Furthermore, if the profiled members are helical as described with reference to FIG. 14, the axial thrust thus created must be sufficient to balance the tendency of the profiled members to become "unscrewed" relative to each other under the action of the working forces exerted between the profiles 3 and 4.

For example, if with the embodiment shown in FIG. 15 the axial thrust selected is too great, the sealing devices 41 and 42 shown as acting on contact with the shaft 23 can be moved radially outwards beyond the axial stops 33 and 34, therefore between each flange and the corresponding end wall 31 of the housing. Furthermore, the shaft 23 must be mounted with a certain freedom of axial slide to allow for the axial wandering of the profiled member 1 between the flanges 31 and 32. The profiled outer member 2 is free to rotate so that its driving results from its cooperation with the profiled member 1 and the working fluid.

Figure 16:
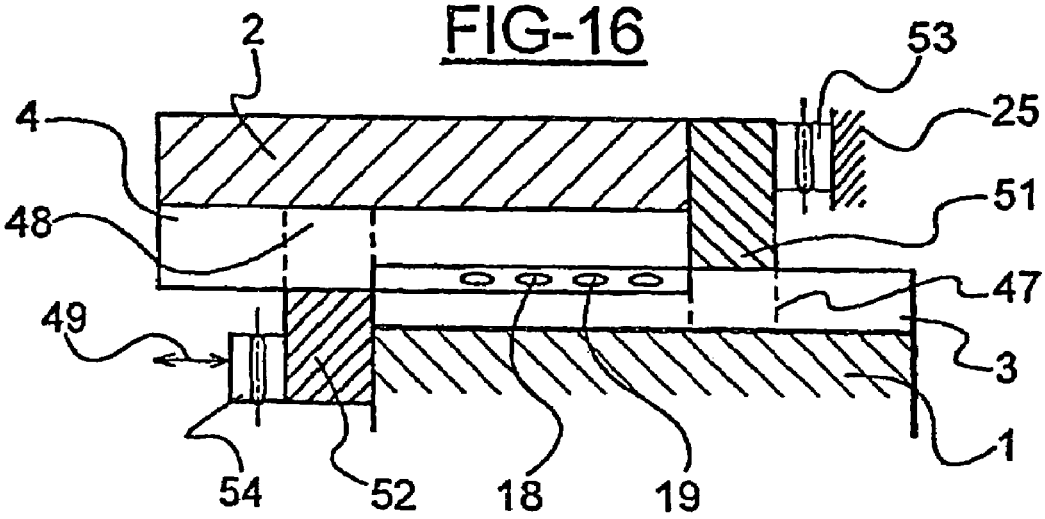
FIG. 16 is a partial axial sectional view of a machine according to the invention, with variable capacity.
Figure 17A:
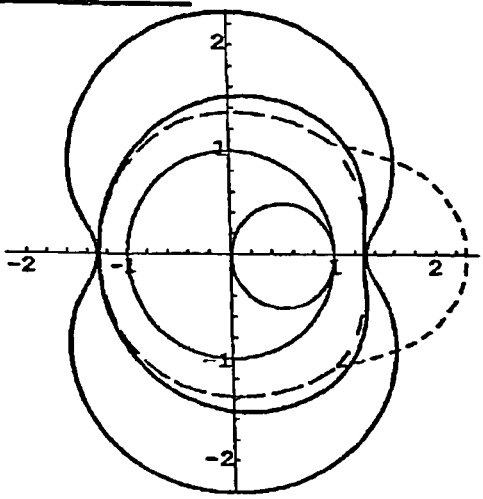
FIGS. 17A and 17B show, in two different states, a machine in the second class according to the invention, with a one-lobed inner profile.
Figure 17B:
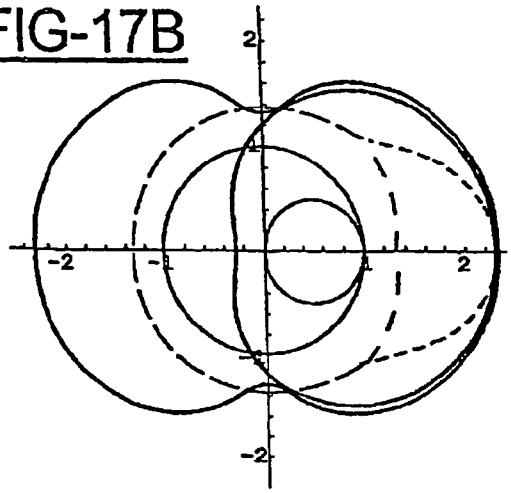
Figure 18A:
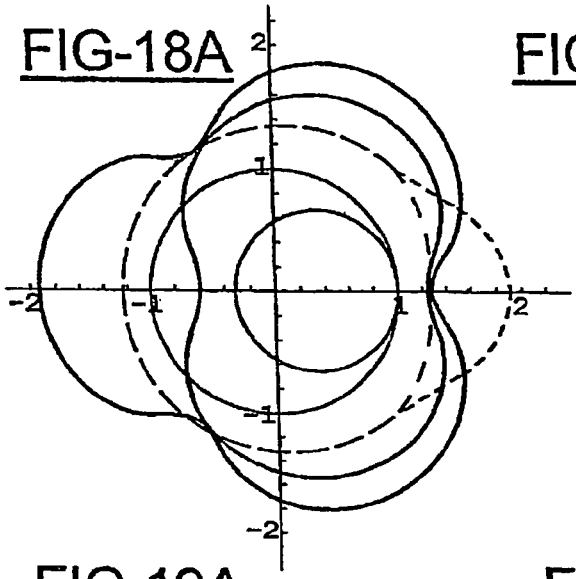
FIGS. 18A and 18B show, in two different states, a machine in the second class according to the invention, with a bi-lobed inner profile.
Figure 18B:
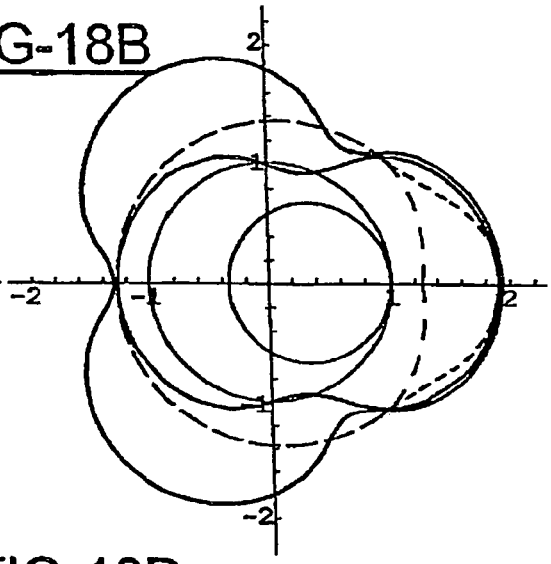

In the example shown in FIG. 16, the machine is a variable capacity machine. For this, the profiled members 1 and 2 slide axially relative to each other. In the example shown, the profiled member 2 is fixed axially, resting against the housing 25 by means of an axial stop 53 and a flange 51. The profiled member 1 slides axially relative to the housing by means of an actuator 49 that is only schematically shown, acting on the member 1 by means of an axial stop 54 and a flange 52. The flange 51 rests tightly against a flat end surface of the outer profiled member 2 and has as a radially inner edge a profiled surface 47 that is exactly complementary to the profile 3 of the profiled member 1. Thus, the flange 51 is in tight contact with the profile 3 around the entire circumference of the profiled member 1, to slide axially relative to the profiled member 1 whilst being driven rotatably by the profiled member 1.

Similarly, the flange 52 is resting tightly against a flat end surface of the profiled member 1 and has on its outer circumference a profiled surface 48 that is exactly complementary to the profile 4 of the profiled member 2 so that it rests tightly on it, sliding axially, and ensuring the rotation of the flange 52 with the profiled member 2. The distribution is ensured by the channels 18, 19 according to the embodiment in FIG. 12A.

Figure 22A:
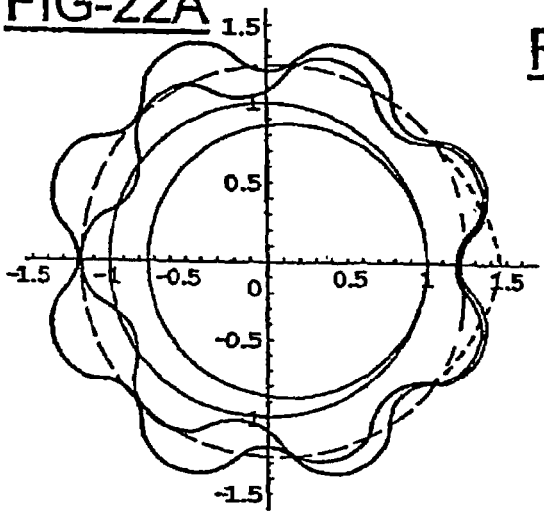
FIGS. 22A and 22B show, in two different states, a machine in the second class according to the invention, with a seven-lobed inner profile.
Figure 22B:
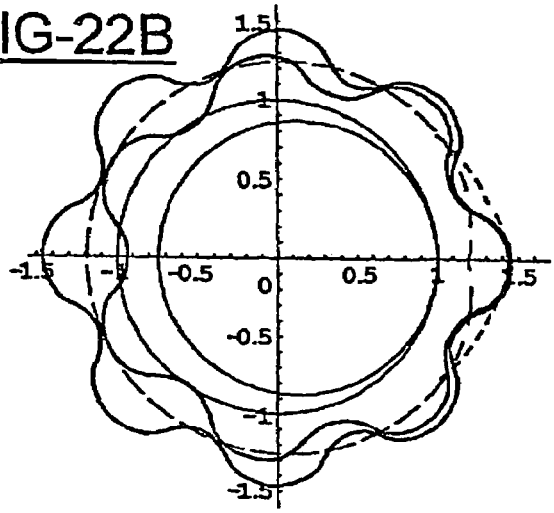
Figure 23A:
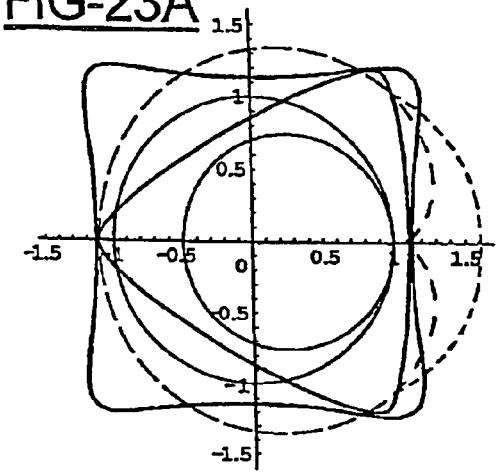
FIGS. 23A and 23B show, in two different states, a machine in the second class according to the invention, with a tri-lobed inner profile in a different geometry to the geometry in FIGS. 19A and 19B.
Figure 23B:
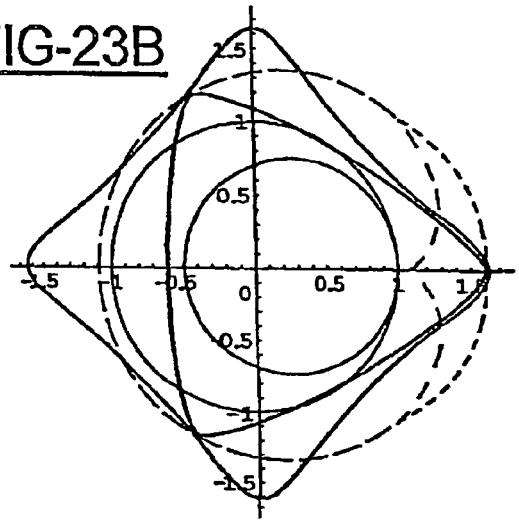
Figure 24A:
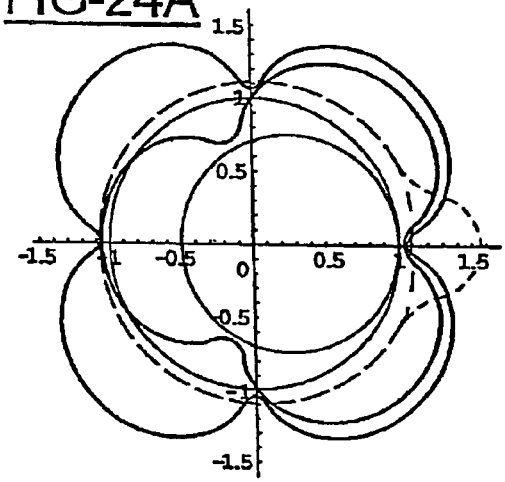
FIGS. 24A and 24B are analogous to FIGS. 23A and 23B respectively, but in yet another geometry.
Figure 24B:
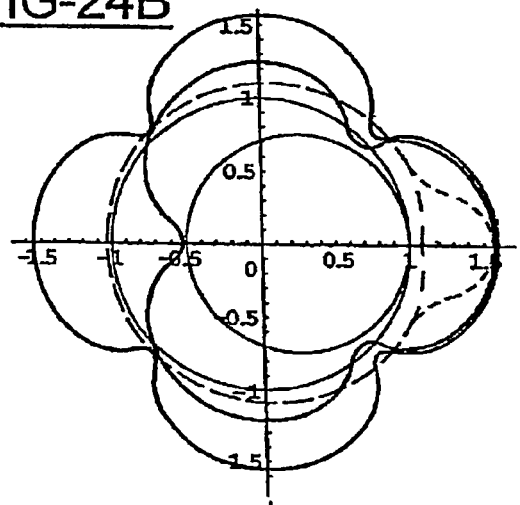
Figure 25A:
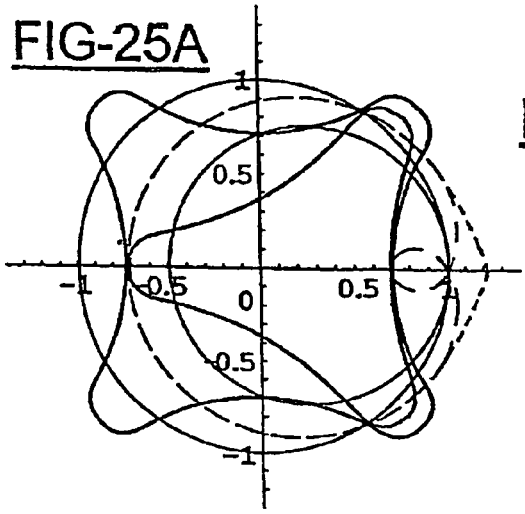
FIGS. 25A and 25B are analogous to FIGS. 23A and 23B respectively, but in yet another geometry.
Figure 25B:
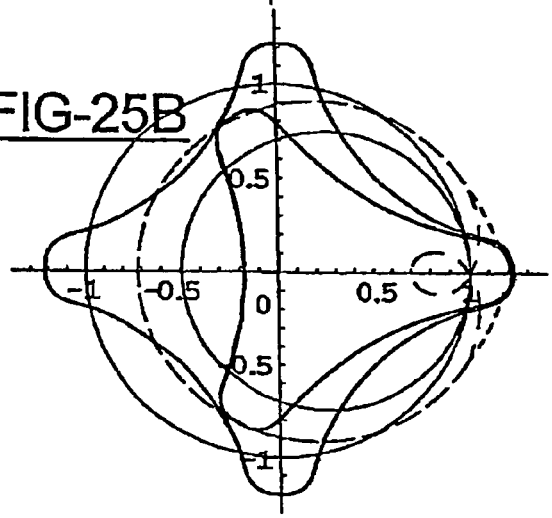

FIGS. 17A to 22B show various embodiments, each in two operating states, of machines in the second class, with numbers of lobes ranging from one for the profiled inner member and 2 for the profiled outer member (FIGS. 17A and 17B) to 7 for the profiled inner member and 8 for the profiled outer member (FIGS. 22A and 22B).

Figure 19A:
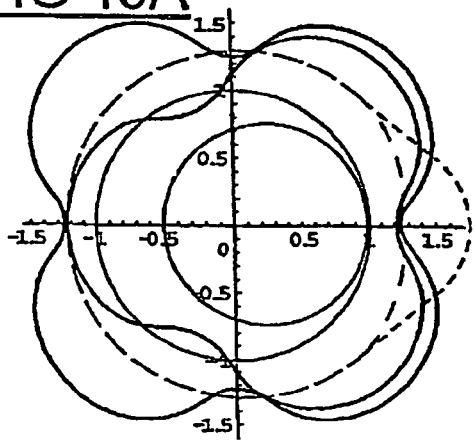
FIGS. 19A and 19B show, in two different states, a machine in the second class according to the invention, with a tri-lobed inner profile.
Figure 19B:
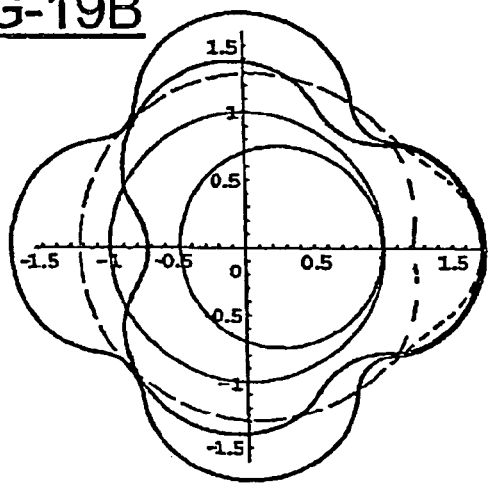
Figure 20A:
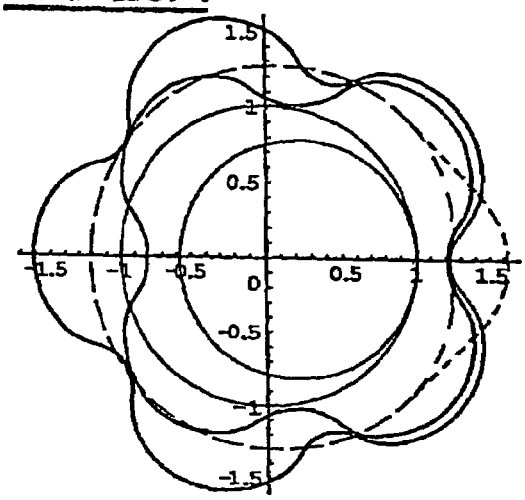
FIGS. 20A and 20B show, in two different states, a machine in the second class according to the invention, with a four-lobed inner profile.
Figure 20B:
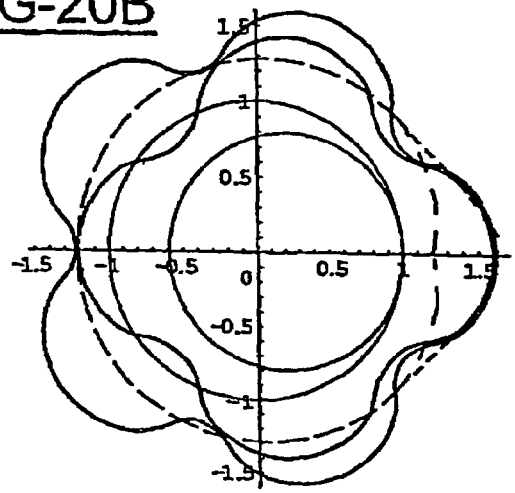
Figure 21A:
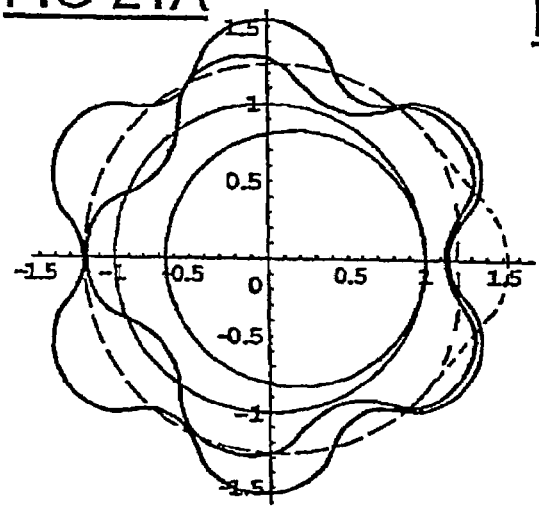
FIGS. 21A and 21B show, in two different states, a machine in the second class according to the invention, with a five-lobed inner profile.
Figure 21B:
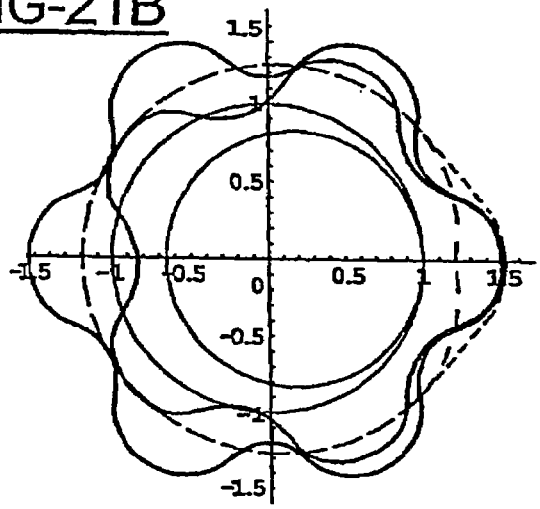

By comparison with the embodiment in FIGS. 19A and 19B, when the profiled inner member is tri-lobed and the profiled outer member is four-lobed, FIGS. 23A to 25B show three other possible geometries that illustrate the great variety of the geometries that can be achieved for the machines in the second class.

For the machines in the second class, there are two curves of action on the side of the rolling point and just one on the opposite side. The outer curves are simple arcs. The inner curve may have a loop, the double point of which the rolling point; this is not a singularity of the profiles. At the moment when the contact passes through the rolling point, the relative movement of the two profiles is rolling without sliding. In borderline cases for which the curve of action has a cusp point at the rolling point, the speed of the point of contact vanishes at this point.

The description of the chamber cycle is slightly complicated by the possible occurrence of the phenomenon of "chamber splitting" described briefly below. In any case, a chamber appears when the front sides of the lobes of the outer profile pass through the osculating contact, at the intersection BN of the curves of action situated above the axis Ox containing the point R. It passes through its maximum after a rotation of just over a half-revolution. The chamber is then on the opposite side to the rolling point relative to the pivots. The closing of the chamber is symmetrical with its opening, and the "lifetime" of the chamber is a little greater than one revolution.

The phenomenon of chamber splitting might arise for chambers close to their appearance or disappearance, that is, when two lobes are strongly engaged with each other on the side of the rolling point. The volumes of the chambers in question are small. The sequence is as follows: at a point inside a closing chamber, the two profiles reach an exceptional osculating contact, and the chamber is split into two sub-chambers. The new osculating contact disintegrates into two simple contacts between which a new chamber appears. Each of the two contacts meets the corresponding edge of one of the two closing sub-chambers and they disappear (generally at different moments), one in a normal way when it passes through the confluence of the curves of action, and the other in an exceptional way through an osculation that disappears on the spot. At this point, the new chamber coalesces with another new chamber that appears normally at the bifurcation of the curves of action.

This slightly difficult phenomenon of chamber splitting takes place if the profiles become tangent to the outer curve of action on the side of the rolling point, but outside the axis Ox.

Figure 26A:
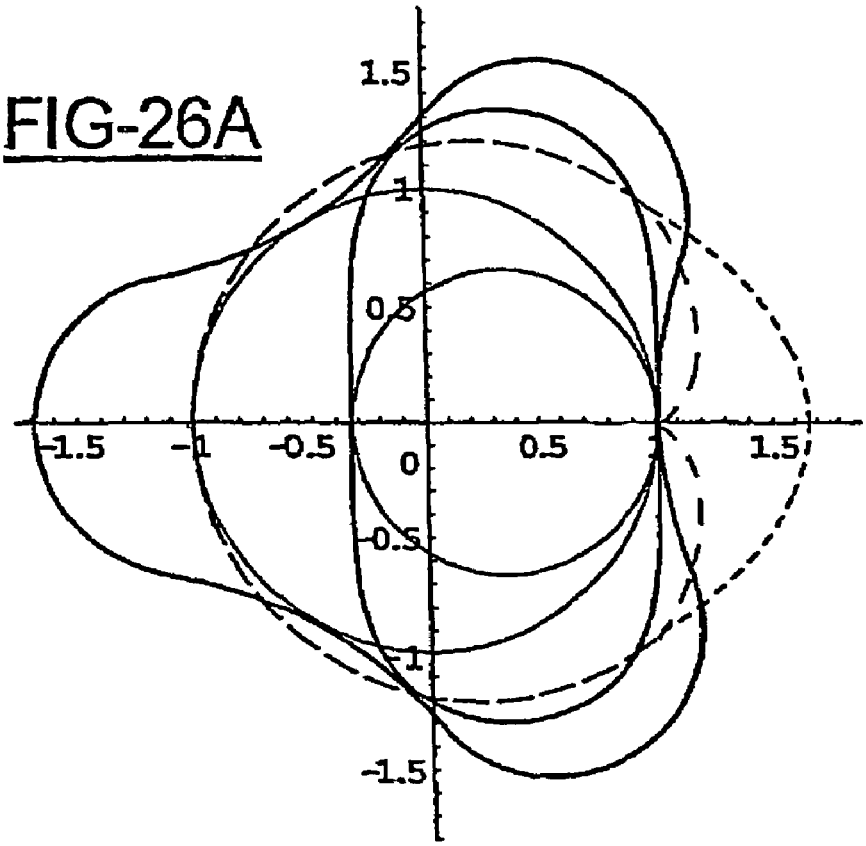
FIGS. 26A and 26B show, in two different states, a machine in the second class according to the invention, with a bi-lobed inner profile but in a different geometry to the geometry in FIGS. 18A and 18B, more particularly appropriate for the production of a compressor.
Figure 26B:
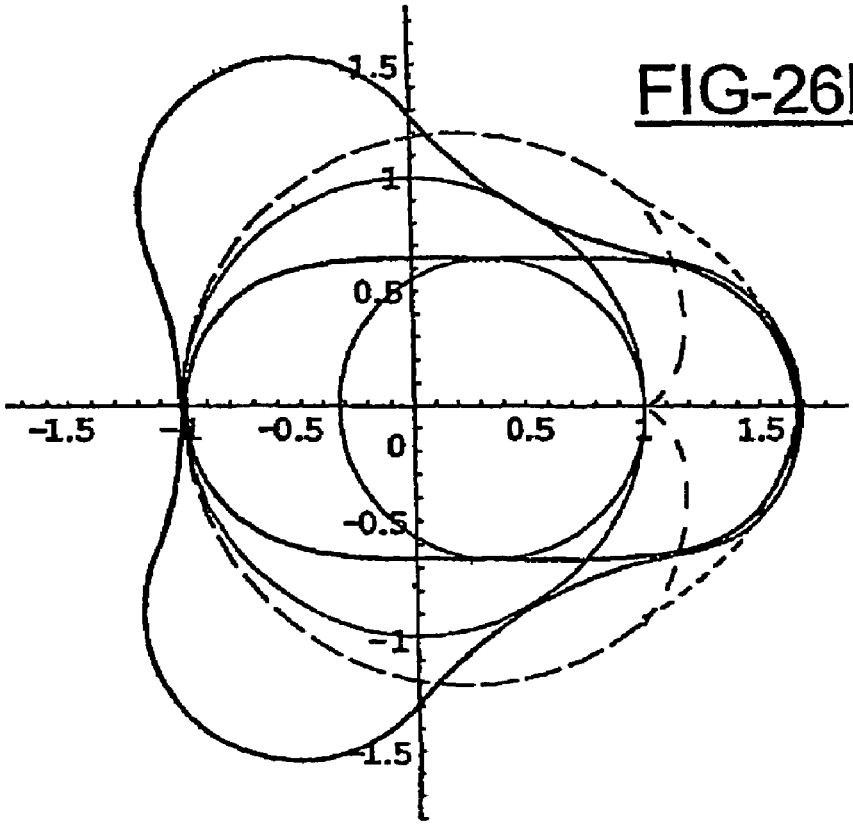

FIGS. 26A and 26B show a particularly appropriate geometry for the production of a compressor. It is a machine in class two, with a bi-lobed profiled inner member and a tri-lobed profiled outer member. A machine of this type and more generally a machine according to the invention has the following advantageous specific features for the production of a compressor, both of which contribute to limiting leaks:

- the chambers are completely emptied; a single flap valve can therefore be used to eliminate backflow towards the low pressure;
- the relative curvature of the surfaces in "contact" (generally, these machines are not self-driven and contact is not reached) is limited; leaks therefore occur through a passage that is not only as narrow as manufacturing precision allows, but also remains narrow over a certain length.

The aim is to raise as many obstacles as possible between the low pressure side and the high pressure side of the compressor. It is therefore natural to turn the attention more to the second class of conjugate profiles; during the growth phase, the consecutive chambers remain at the inlet pressure, and during the volume shrinkage phase, compression is progressive. It is only at the end of compression that the closing chamber is adjacent to two low pressure chambers: along the outer curve of action with an appearing chamber and along the inner curve of action with a growing chamber. In both cases, the concavities of the surfaces in contact are in the same direction and the relative curvature is small (it vanishes at the end of discharge) A profile that does not give rise to chamber splitting, such as the one in FIGS. 26A and 26B, will be chosen.

The helical embodiment is possible and gives the same high quality of contact as the straight embodiment.

For a compressor, it may be preferred to keep the outer profile fixed (which then becomes the profile of the housing) and give the rotor a planetary movement; the connecting member is then rotating relative to the housing around the axis 0 of the profiled outer member.

Figure 27A:
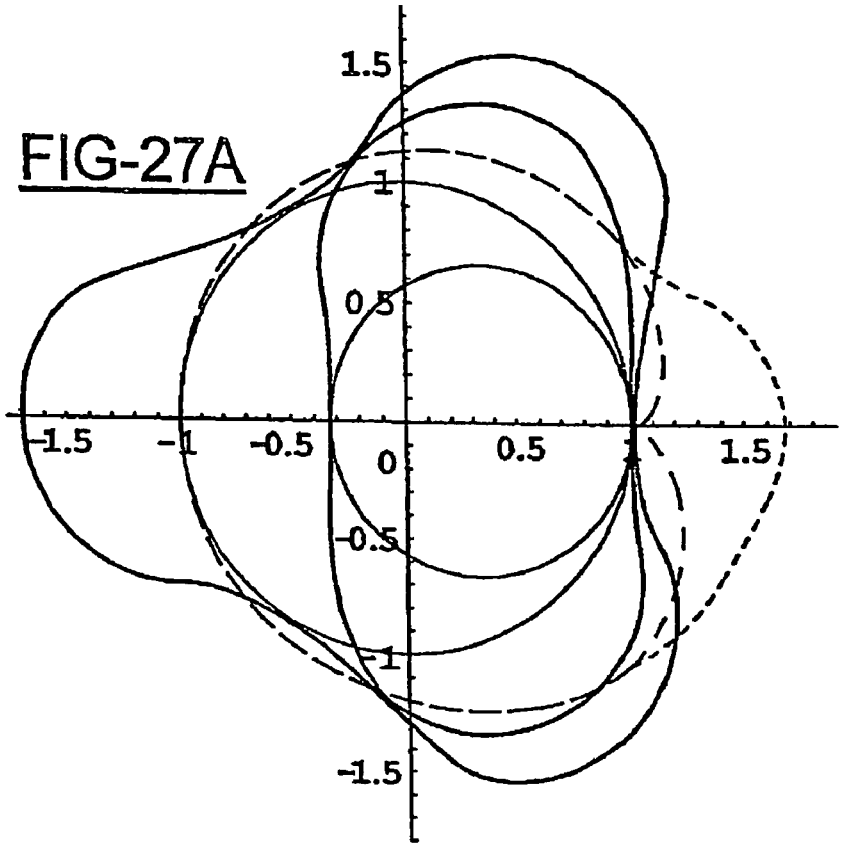
FIGS. 27A and 27B are analogous to FIGS. 26A and 26B, but with asymmetrical profiles.
Figure 27B:
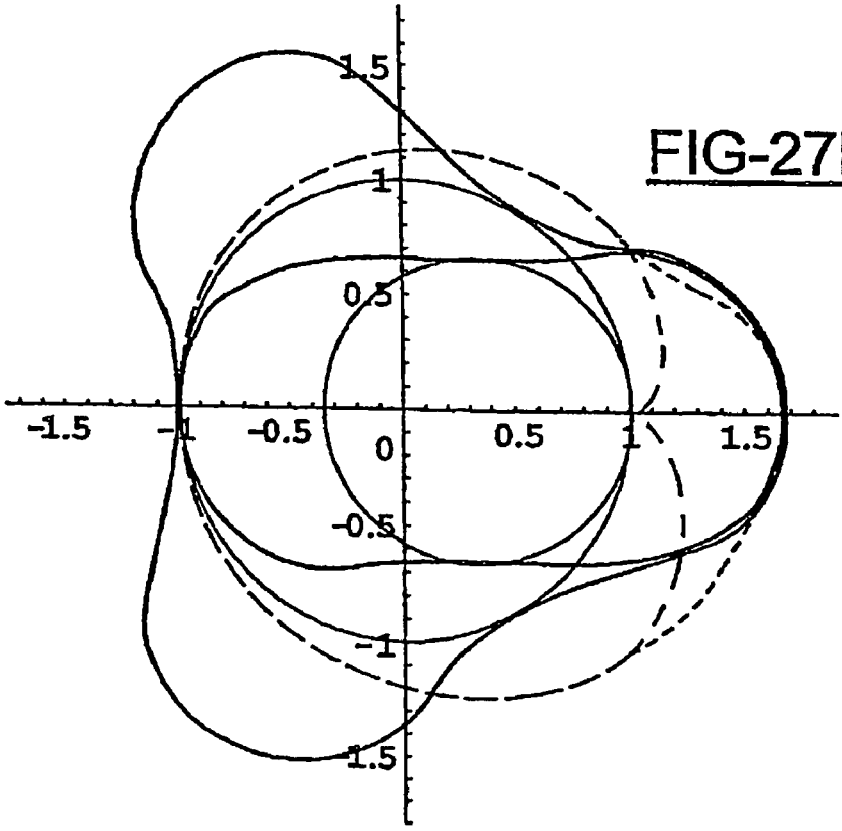

In a compressor, the properties of the fluid also change between intake and discharge; in addition, the parameters to be optimized are not the same on intake (limitation of pressure loss) and on discharge (limitation of leaks). For these reasons, it may be preferred to use asymmetrical profiles. An example of this is given in FIGS. 27A and 27B.

Figure 28A:
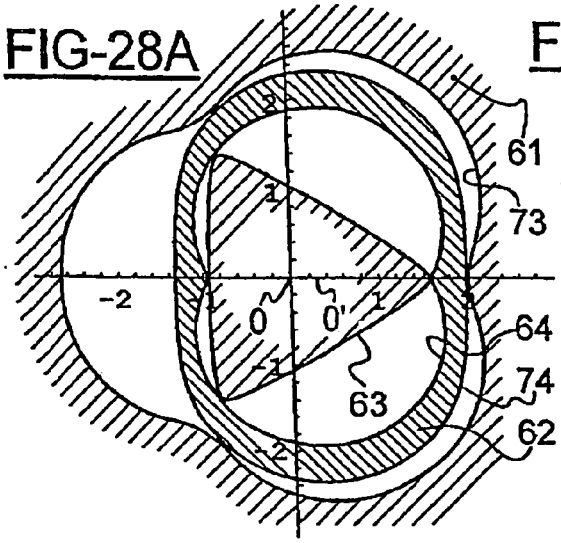
Figure 28B:
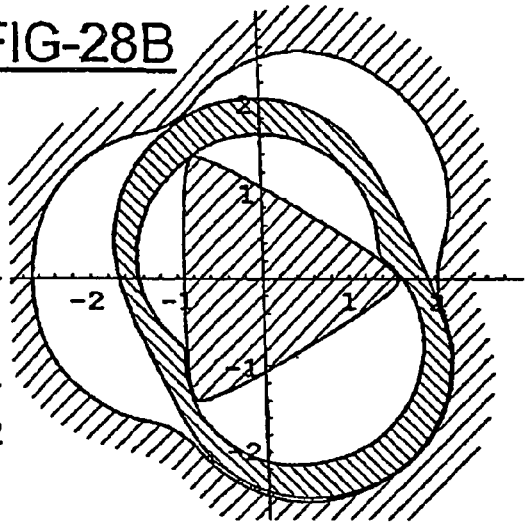
Figure 28C:
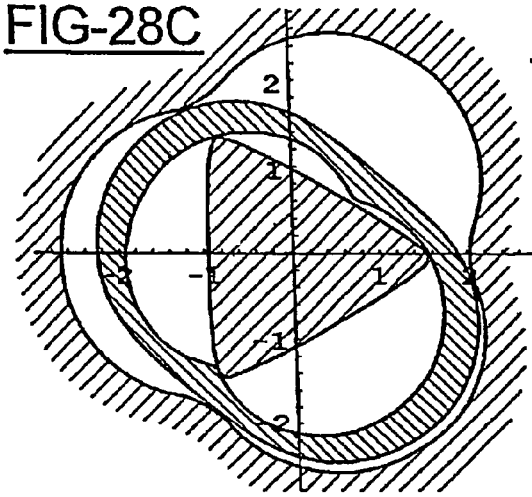
Figure 28D:
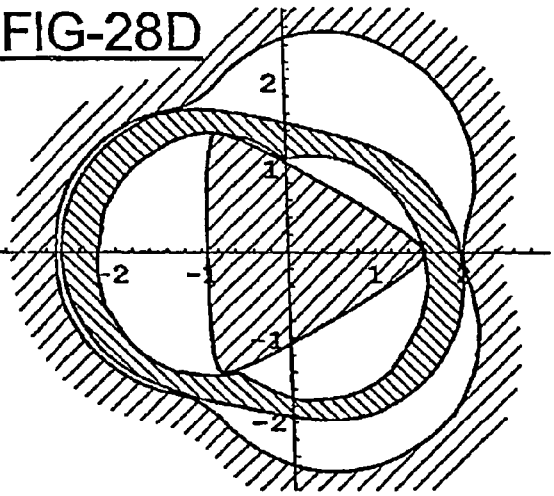
Figure 28E:
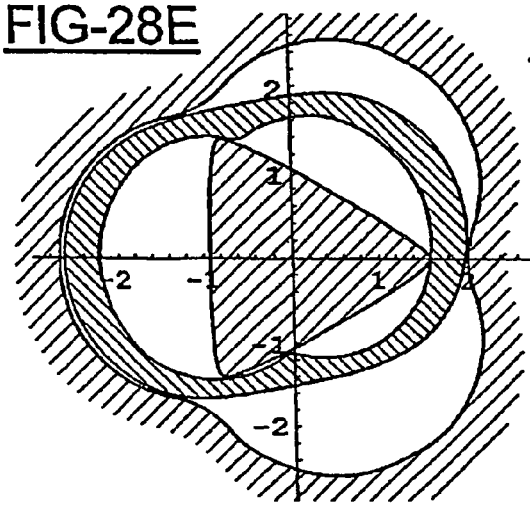
Figure 28F:
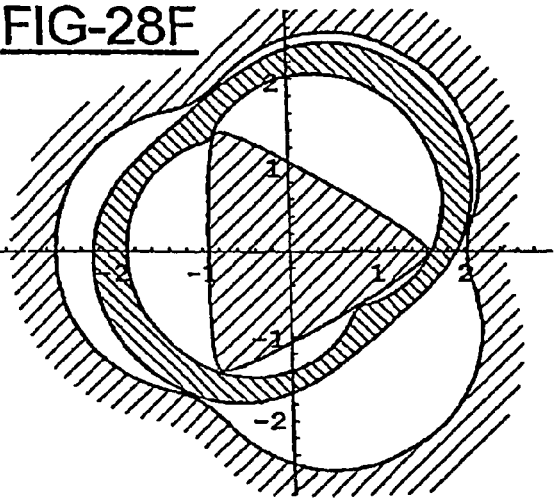
Figure 29A:
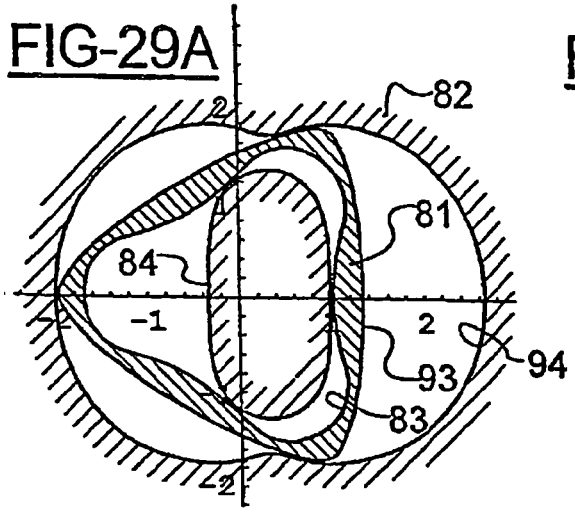
Figure 29B:
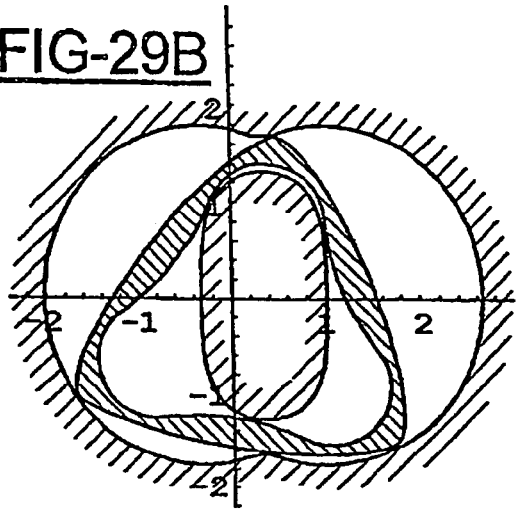
Figure 29C:
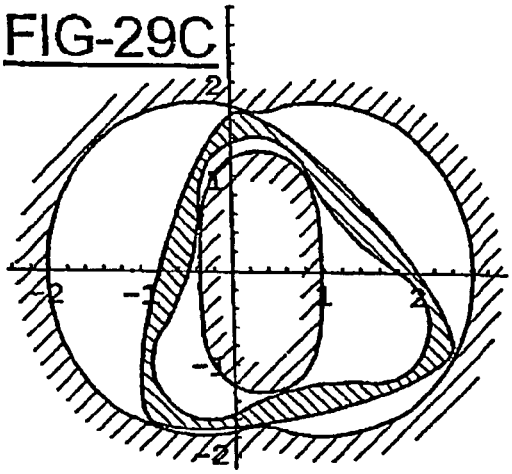
Figure 29D:
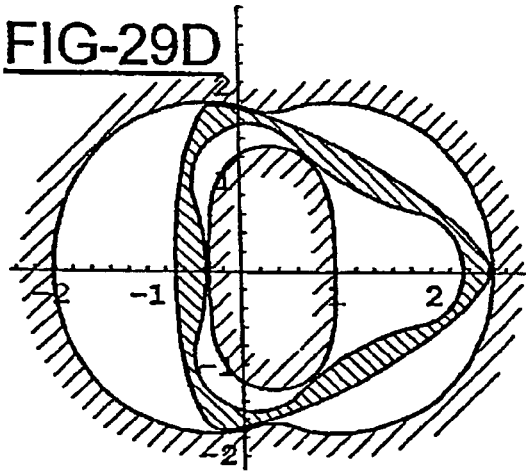
Figure 29E:
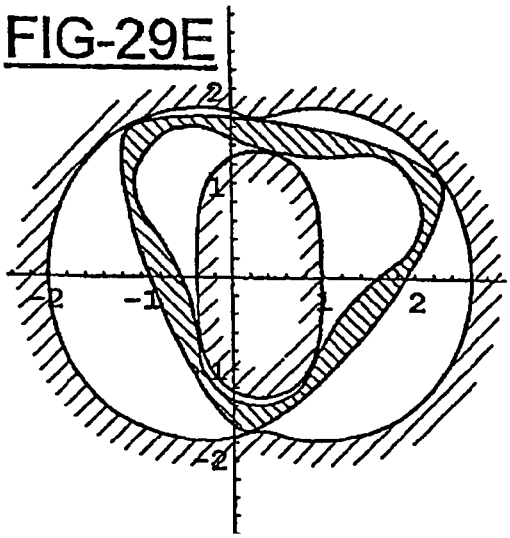
Figure 29F:
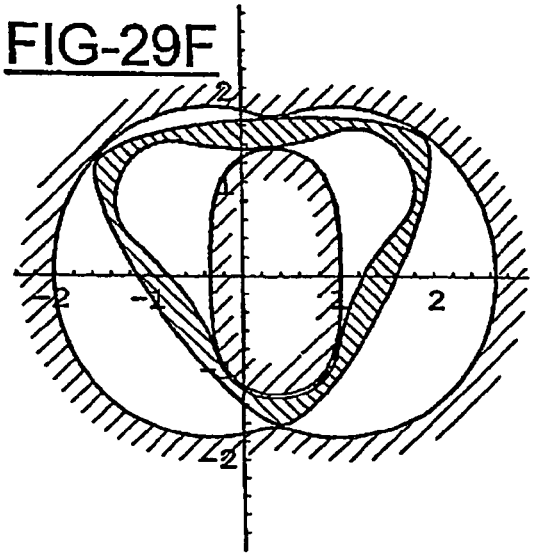

In the example shown in FIGS. 28A and 28F, an intermediate profiled member 62 comprises a first profile 64 of order m−1 on its radially inner surface, and a second profile 74 of order (m−1) on its radially outer surface. The two profiles have the same pitch circle centered on O'. Each of the (m−1)-lobed profiles 64, 74 cooperates with an m-lobed profile 63, 73 of a profiled member 61 that is shown fixed in this example. The two profiles 63, 73 also have a common pitch circle, which is centered on O. The profiles 63 and 64 form a machine in the first class according to the invention and the profiles 73 and 74, a machine in the second class according to the invention.

In the example shown in FIGS. 29A to 29F, the difference is that the intermediate profiled member 82 has two m-lobed profiles cooperating with two )m−1)-lobed profiles belonging to a profiled member 81.

Such geometry could allow for the production of an internal combustion engine in which, for example, the inner machine would be used for intake and compression, whilst the outer machine would be used for expansion and exhaust.

Of course, the invention is not limited to the examples described and shown.

In the examples described, and more particularly in the example in FIG. 15, the profile inner member is driven rotatably and the profiled outer member rotates due to the torque transmitted at the contact points between the profiled inner member and the profiled outer member, which rotates freely in the housing. Furthermore, during operation as a motor, the pressure of the hydraulic fluid tends to cause the cavities subject to this pressure to move towards an increase in their volume, which contributes to forcing the profiled outer member in the desired direction of rotation. However, provision could also be made for an external drive, for example by gearing, that forces the two profiled members to rotate in a speed ratio corresponding to the ratio of the number of their lobes. Equally, the profiled outer member could be driven and the profiled inner member left free. One of the two profiled members can further be fixed to the housing and the other profiled member driven in a planetary movement by rotating the centre of the pitch circle of the other profiled member around the centre of the pitch circle of the fixed profiled member. In this configuration, said other profiled member can be left to position itself freely around its own axis or on the contrary, its angular position can be determined, for example by gearing, as a function of the angular position of the connecting member around the centre of the fixed profiled member.

The invention is compatible with the Moineau principle by which, as described in U.S. Pat. No. 1,892,217, the helical shape of the two profiled members extends over sufficient pitches so that no cavity opens simultaneously at the two axial ends of the machine. Due to the accuracy and quality of the geometry according to the invention, it is possible to limit the total angular displacement between the profiles at the two ends of the machine to a value hardly greater than the lifetime of the chamber in each plane perpendicular to the axes.

The pitch is not necessarily the same throughout the machine, and the profile can further be varied along the axes of the machine. This allows for example for the production of a compressor or an expansion motor in which the volume of the transferring chambers varies progressively.

The invention claimed is:

1. A displacement machine comprising:

two profiled members, inner and outer respectively, that have an annular inner profile and an annular outer profile, a connecting member with respect to which each of the profiled members is rotatably supported about a respective axis of rotation (O, O'; O', O), and in which:

one of the profiles is m-lobed and the other is (m−1)-lobed, and they are defined around the axis of rotation of their respective profiled member by m and (m−1) lobes respectively, wherein each lobe of the profile of each profiled member comprises a lobe dome arc and a lobe hollow arc, each profile is the envelope of the other during relative rotations of the profiled members around their respective axis of rotation with meshing of their profiles, which define the chamber contours between them, and rolling without sliding between two pitch circles centred on the respective axes of rotation, wherein relative positions of the profiled members for which a contact point ($C_2$) between the profiles is located on the tangent to the two pitch circles at their mutual rolling point, the profiled members have at said point of contact equal continuous curvatures in the same direction with said rolling point (R) as their common centre.

2. The machine according to claim 1, wherein:

points M belonging to a given arc that is one of said lobe dome arc and said lobe hollow arc of the m-lobed profile are defined by two functions $\rho(\delta)$ and $\sigma(\delta)$ connecting parameters $\rho$, $\delta$, and $\sigma$, which are:

$\rho$: measured along the normal to the arc at point M, the distance between point M and the middle N between the two points of intersection (P) and (D), proximal and distal respectively, of the said normal with the pitch circle with centre O of the m-lobed profile, and with a radius assumed equal to 1, the proximal point of intersection (P) being located between point M on the given arc and the distal point of intersection (D), $\delta$: angular half-distance between the intersection points (D and P) relative to the centre O, measured clockwise, $\sigma$: polar angle of the proximal point of intersection P relative to O, minus $\delta$, the functions $\rho(\delta)$ and $\sigma(\delta)$ having a domain of definition between $\delta=0$ and $\delta=\pi$, two arcs of the pattern of the (m−1)-lobed profile are a proximal conjugate arc and a distal conjugate arc defined below in a Cartesian reference system with its origin at the centre O of the pitch circle associated with the m-lobed profile:

a) proximal conjugate arc:

$$x_{CjP}(\delta) = \left(1 + (\sin(\delta) - m\rho(\delta))\sin\left(\frac{\delta - m\sigma(\delta)}{m-1}\right) + (m-1)\cos(\delta)\cos\left(\frac{\delta - m\sigma(\delta)}{m-1}\right)\right)\Big/ m$$

$$y_{CjP}(\delta) = \left((\sin(\delta) - m\rho(\delta))\cos\left(\frac{\delta - m\sigma(\delta)}{m-1}\right) - (m-1)\cos(\delta)\sin\left(\frac{\delta - m\sigma(\delta)}{m-1}\right)\right)\Big/ m$$

b) distal conjugate arc:

$$x_{CjP}(\delta) = \left(1 + (\sin(\delta) + m\rho(\delta))\sin\left(\frac{\delta + m\sigma(\delta)}{m-1}\right) + (m-1)\cos(\delta)\cos\left(\frac{\delta + m\sigma(\delta)}{m-1}\right)\right)\Big/ m$$

$$y_{CjP}(\delta) = \left(-(\sin(\delta) + m\rho(\delta))\cos\left(\frac{\delta + m\sigma(\delta)}{m-1}\right) + (m-1)\cos(\delta)\sin\left(\frac{\delta + m\sigma(\delta)}{m-1}\right)\right)\Big/ m.$$

3. The machine according to claim 2, wherein a derivative ρ' relative to δ where δ=0 and δ=π satisfies the following strict inequalities:

$$1/m > \rho'(0) > 0$$

$$-1/m < \rho'(\pi) < 0$$

in that the m-lobed profile is inside the (m−1)-lobed profile, and in that the m-lobed profile is complemented by a proximal complementary arc defined by its coordinates in the said Cartesian reference system:

$$x_{C_pP}(\delta) = \left((2\sin(\delta) - m\rho(\delta))\sin\left(\frac{2\delta}{m} - \sigma(\delta)\right) + m\cos(\delta)\cos\left(\frac{2\delta}{m} - \sigma(\delta)\right)\right)\Big/ m$$

$$y_{C_pP}(\delta) = \left((2\sin(\delta) - m\rho(\delta))\cos\left(\frac{2\delta}{m} - \sigma(\delta)\right) - m\cos(\delta)\sin\left(\frac{2\delta}{m} - \sigma(\delta)\right)\right)\Big/ m.$$

4. The machine according to claim 3, wherein a fulfilment of the following conditions over an entire interval ]0,π[ of variation of the coordinate δ:

$$(\rho(\delta)\rho'(\delta))/\cos(\delta) - \sin(\delta) \neq 0$$

$$(m\rho(\delta) - 2\sin(\delta))\rho'(\delta)/(m\cos(\delta)) - (2m\rho(\delta) + (m^2-4)\sin(\delta))/m^2 \neq 0$$

$$(m\rho(\delta) - \sin(\delta))\rho'(\delta)((m-1)\cos(\delta)) - (\rho(\delta) + (m-2)\sin(\delta))/(m-1) \neq 0$$

$$(m\rho(\delta) + \sin(\delta))\rho'(\delta)/((m-1)\cos(\delta)) + (\rho(\delta) - (m-2)\sin(\delta))/(m-1) \neq 0.$$

5. The machine according to claim 3, wherein the functions ρ(δ) and σ(δ) are:

$$\rho(\delta) = (1 - 1/n)(1/\cos(\phi)^2 - \cos(\delta)^2)^{1/2} + (1/n)\sin(\delta) + \rho_0$$

$$\sigma(\delta) = (1 - 1/n)\arccos(\cos(\delta)\cos(\phi)) + (\delta/n)$$

that define the given arc as a curve parallel to a curtate epicycloid, and where:

n is a real number that is the order of the epicycloid,

ϕ is an angular parameter of between 0 and π/2, which describes the contraction of the curtate epicycloid, $\rho_0$ is a parameter characterising the distance of parallelism to the curtate epicycloid.

6. Machine according to claim 5, characterised in that n is taken as close to 2m−2.

7. The machine according to claim 3, wherein the machine further comprises:

two flanges between which the profiled members are installed, and which are rotatably connected to one of the profiled members;

inlet ports through a first of the flanges near a side of each of the lobe domes of the profile of the profiled member to which the flanges are rotatably connected; and discharge ports through a second of the flanges near another side of each of the said lobe domes.

8. The machine according to claim 7, wherein the machine further comprises means of selectively closing at least some of the ports in at least an angular area close to an intersection between a common tangent (T) of the pitch circles and on the other hand curves of action ($CA_1$, $CA_2$, $CA_3$) defined by the trajectories of the points of contact between profiles.

9. The machine according to claim 7, wherein there is an angular displacement between a profile of the profiled members on the side of one of the flanges and a profile of the profiled members on the side of the other flange, such that each chamber passing through its maximum volume ceases to communicate with a port through one of the flanges approximately at the moment when it starts to communicate with a port through the other flange.

10. The machine according to claim 3, wherein the machine further comprises in the profiled outer member, distribution channels opening on the one hand into the profile at the connection of the arcs and communicating on one side of the lobe domes with the intake and on the other side of the lobe domes with the discharge.

11. The machine according to claim 2, wherein a derivative ρ' relative to δ where δ=0 and δ=π satisfies the following strict inequalities:

$$-1/m < \rho'(0) < 0$$

$$1/m > \rho'(\pi) > 0$$

in that the m-lobed profile is outside the (m−1)-lobed profile; and in that the m-lobed pattern is complemented by a distal complementary arc defined by its coordinates in the said Cartesian reference system with centre O:

$$x_{C_pD}(\delta) = \left((2\sin(\delta) + m\rho(\delta))\sin\left(\frac{2\delta}{m} + \sigma(\delta)\right) + m\cos(\delta)\cos\left(\frac{2\delta}{m} + \sigma(\delta)\right)\right)\Big/ m$$

$$y_{C_pD}(\delta) = \left(-(2\sin(\delta) + m\rho(\delta))\cos\left(\frac{2\delta}{m} + \sigma(\delta)\right) + m\cos(\delta)\sin\left(\frac{2\delta}{m} + \sigma(\delta)\right)\right)\Big/ m.$$

12. The machine according to claim 11, wherein fulfilment of the following conditions over an entire interval ]0,π[ of variation of the coordinate δ:

$$(\rho(\delta)\rho'(\delta))/\cos(\delta) - \sin(\delta) \neq 0$$

$$(m\rho(\delta) + 2\sin(\delta))\rho'(\delta)/(m\cos(\delta)) + (2m\rho(\delta) - (m^2-4)\sin(\delta))/m^2 \neq 0$$

$$(m\rho(\delta) - \sin(\delta))\rho'(\delta)/((m-1)\cos(\delta)) - (\rho(\delta) + (m-2)\sin(\delta))/(m-1) \neq 0$$

$$(m\rho(\delta) + \sin(\delta))\rho'(\delta)/((m-1)\cos(\delta)) + (\rho(\delta) - (m-2)\sin(\delta)/(m-1) \neq 0.$$

13. The machine according to claim 11, wherein the profiles only pass through a single point of tangency with the outermost trajectory ($CB_3$) followed by the contact points.

14. The machine according to claim 11, wherein the functions $\rho(\delta)$ and $\sigma(\delta)$ are:

$$\rho(\delta)=(1+1/n)(1/\cos(\phi)^2-\cos(\delta)^2)^{1/2}-(1/n)\sin(\delta)-\rho_0$$

$$\sigma(\delta)=(1+1/n)\arccos(\cos(\delta)\cos(\phi))-(\delta/n)$$

that define the given arc as a curve parallel to a curtate epicycloid and where:

n is a real number that is the order of the epicycloid, $\phi$ is an angular parameter of between 0 and $\pi/2$, which describes the contraction of the curtate epicycloid, $\rho_0$ is a parameter characterising the distance of parallelism to the curtate epicycloid.

15. The machine according to claim 1, wherein each lobe is symmetrical relative to an axial plane passing through the vertex of the lobe.

16. The machine according to claim 1, wherein each lobe is dissymmetrical relative to an axial plane passing through the vertex of the lobe.

17. The machine according to claim 1, wherein the connecting member is firmly attached to a housing, and in that one of the profiled members is at least indirectly rotatably connected to a drive shaft.

18. The machine according to claim 17, wherein the other profiled member rotates freely around its axis of rotation.

19. The machine according to claim 1, wherein the profiles are each progressive along the axis of rotation of their respective profiled member, the points of tangency of the pitch circles being aligned on a straight line parallel to the two axes of rotation.

20. The machine according to claim 19, wherein the profiles are progressive by angular displacement of a constant profile around the axis of rotation.

21. The machine according to claim 20, wherein the profiles progress into a constant pitch helix.

22. The machine according to claim 19, wherein the angular displacement of the profiles from one end surface of the profiled members to the other is hardly greater than required for a chamber at its maximum volume to be simultaneously adjacent to a disappearing chamber at one axial end of the profiled members and to an appearing chamber at the other axial end of the profiled members.

23. The machine according to claim 1, wherein the profiles are constant along their respective axis of rotation, have a constant degree of angular displacement, finite or infinite, along their respective axis of rotation, in that the profiled members can be moved axially relative to each other, and in that the machine comprises at each end a flange complementary to one of the profiles respectively and resting tightly against an end surface of the profiled member holding the other profile.

24. The machine according to claim 1, wherein the profiled members are mounted between two flanges closing the chambers at their axial ends, and in that the machine comprises pressing means to press the flanges axially against the profiled members.

25. The machine according to claim 24, wherein each flange is rotatably firmly attached to one of the profiled members.

26. The machine according to claim 24, wherein the pressing means are means of subjecting at least part of the outer surface of a first of the flanges to a high pressure of a working fluid to push the first flange against the profiled members and thus push the profiled members against the second flange.

27. The machine according to claim 26, wherein the machine includes distribution means that comprise at least one port formed in the first flange for the high-pressure working fluid.

28. The machine according to claim 27, wherein the distribution means comprise at least one port formed in the second flange for a low-pressure fluid.

29. The machine according to claim 27, wherein the ports are rotatably firmly attached to the outer profiled member.

30. The machine according to claim 1, wherein the machine further comprises distribution means comprising ports which are connected for common rotation with one of the profiled members, and which are selectively revealed and hidden by the other profiled member.

31. The machine according to claim 30, wherein the ports have tips coinciding with a connection point of the arcs forming the profile to which the ports are integral, on an appearance side of the chambers for some of the ports being inlet ports and on a disappearance side of the chambers for other of the ports being discharge ports.

32. The machine according to claim 1, wherein one of the profiled members has two m-lobed profiles, one on a radially inner annular surface and the other on a radially outer annular surface, which have the same pitch circle and each cooperate with an (m−1)-lobed profile, and in that the (m−1)-lobed profiles have the same pitch circle and are held by the other profiled member.

33. The machine according to claim 32, wherein the two m-lobed profiles are facing away from each other and are radially between the two (m−1)-lobed profiles (84, 94).

34. The machine according to claim 1, wherein one of the profiled members has two (m−1)-lobed profiles, one on a radially inner annular surface and the other on a radially outer annular surface, which have the same pitch circle and each cooperate with an m-lobed profile, and in that the m-lobed profiles have the same pitch circle and are held by the other profiled member.

35. The machine according to claim 34, wherein the two m-lobed profiles are facing towards each other and are radially on either side of the two (m−1)-lobed profiles.

* * * * *